US008376923B2

(12) United States Patent
Nakagawa et al.

(10) Patent No.: US 8,376,923 B2
(45) Date of Patent: Feb. 19, 2013

(54) BAG-MAKING PACKAGING MACHINE

(75) Inventors: Yukio Nakagawa, Shiga (JP); Masashi Kondo, Shiga (JP); Akira Yamamoto, Shiga (JP)

(73) Assignee: Ishida Co., Ltd., Kyoto (JP)

( * ) Notice: Subject to any disclaimer, the term of this patent is extended or adjusted under 35 U.S.C. 154(b) by 476 days.

(21) Appl. No.: 12/702,473

(22) Filed: Feb. 9, 2010

(65) Prior Publication Data

US 2010/0210438 A1 Aug. 19, 2010

(30) Foreign Application Priority Data

Feb. 13, 2009 (JP) ..... 2009-030684

(51) Int. Cl.
*B31B 19/00* (2006.01)

(52) U.S. Cl. ..... 493/186; 493/218; 493/256; 493/313

(58) Field of Classification Search ..... 493/186, 493/218, 219, 256, 313; 53/451, 551, 527
See application file for complete search history.

(56) References Cited

U.S. PATENT DOCUMENTS

| | | | | | |
|---|---|---|---|---|---|
| 2,481,611 | A | * | 9/1949 | Moore | 53/525 |
| 3,332,198 | A | * | 7/1967 | Thesing | 53/436 |
| 3,603,217 | A | * | 9/1971 | Wright et al. | 493/194 |
| 3,857,223 | A | * | 12/1974 | Dominici | 53/526 |
| 3,924,521 | A | * | 12/1975 | Hanson et al. | 493/209 |
| 4,079,662 | A | * | 3/1978 | Puccetti et al. | 53/552 |
| 5,195,829 | A | * | 3/1993 | Watkins et al. | 383/100 |
| 5,398,486 | A | * | 3/1995 | Kauss et al. | 53/551 |
| 6,526,733 | B1 | * | 3/2003 | Schellenberg et al. | 53/551 |
| 2001/0029721 | A1 | | 10/2001 | Sato et al. | |

FOREIGN PATENT DOCUMENTS

| | | | |
|---|---|---|---|
| EP | 0976539 | * | 7/1999 |
| JP | 2000-335511 | A | 5/2000 |

* cited by examiner

*Primary Examiner* — Hemant M Desai
(74) *Attorney, Agent, or Firm* — Global IP Counselors, LLP

(57) ABSTRACT

A bag-making packaging machine includes a bag-producing part, a bag receiving part, and a bottom forming part. The bag-producing part is configured and arranged to transversely seal a tubular packaging material to produce a bag having a top seal part and a bottom seal part formed above and below a product-enclosing main body of the bag. The bag receiving part is configured and arranged to receive and hold the bottom seal part and a part of the main body of the bag, which has been dropped from the bag-producing part. The bottom-forming part is configured and arranged to deform the bag in contact with the bag receiving part to form a bottom portion of the bag into a prescribed shape.

11 Claims, 22 Drawing Sheets

BAG-MAKING PACKAGING MACHINE

CROSS-REFERENCE TO RELATED APPLICATIONS

This application claims priority to Japanese Patent Application No. 2009-030684, filed on Feb. 13, 2009. The entire disclosure of Japanese Patent Application No. 2009-030684 is hereby incorporated herein by reference.

BACKGROUND

1. Field of the Invention

The present invention relates to a bag-making packaging machine.

2. Background Information

A bag-making packaging machine has been used in recent years as an apparatus for packaging articles and producing bags in which a confectionery or other article being packaged is loaded into a bag while the bag is produced. An example of a bag that is produced by a bag-making packaging machine is a free-standing bag such as a gusset-type bag as shown in FIG. 1B. A free-standing bag is superior in ease of product exhibition and display effect, and is used for packaging many kinds of packaged articles.

In the case of producing a gusset-type bag, for example, with the bag-making packaging machine described in Japanese Laid-Open Patent Application No. 2000-335511, first a packaging material is formed into a tubular shape and then the tubular packaging material is sealed transversely and formed into a pillow-shaped bag. In this bag-making packaging machine, transport of the bag is stopped for a time and a transverse seal area (bottom transverse seal part) that is softened by residual heat immediately after sealing is pressed against an L-shaped folding-in member whereby the transverse seal part is folded and is affixed to the bottom part of the bag.

SUMMARY

Nevertheless, with the above conventional bag-making packaging machine, a gusset-type bag must be temporarily stopped while being manufactured.

An object of the present invention is to provide a bag-making packaging machine capable of forming a gusset-type bag without a marked reduction of manufacturing speed.

A bag-making packaging machine according to one aspect of the present invention includes a bag-producing part, a bag receiving part, and a bottom forming part. The bag-producing part is configured and arranged to transversely seal a tubular packaging material to produce a bag having a top seal part and a bottom seal part formed above and below a product-enclosing main body of the bag. The bag receiving part is configured and arranged to receive and hold the bottom seal part and a part of the main body of the bag, which has been dropped from the bag-producing part. The bottom-forming part is configured and arranged to deform the bag in contact with the bag receiving part to form a bottom portion of the bag into a prescribed shape.

In the bag-making packaging machine according to this aspect, the dropped bag is received and held at the bottom seal part and a part of the main body by the bag receiver. The bag in contact with the bag receiver is deformed by the bottom-forming part, and the bottom of the bag is made into a prescribed shape. The term "prescribed shape" refers to a desired bottom shape.

A gusset-type bag can thereby be formed without a marked reduction of manufacturing speed.

BRIEF DESCRIPTION OF THE DRAWINGS

Referring now to the attached drawings which form a part of this original disclosure.

DETAILED DESCRIPTION OF EMBODIMENTS

Figure 1A:
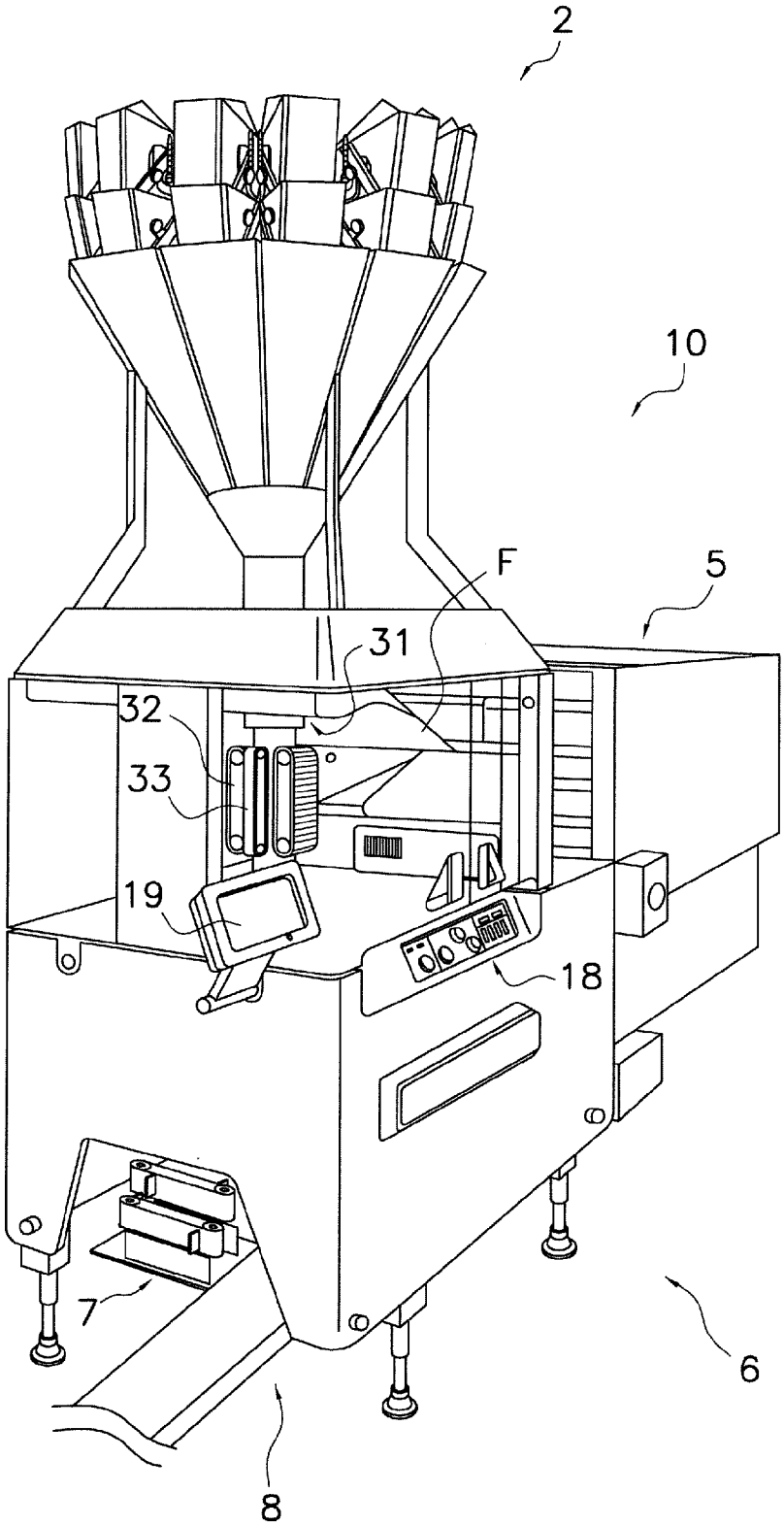
FIG. 1A is a perspective view showing the overall configuration of a bag-making packaging machine according to one embodiment of the present invention.

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

An embodiment of a bag-making packaging machine 10 according to the present invention is described below while referring to the drawings. In the description below, the terms "left" and "right" of the bag-making packaging machine 10 refer to the case when the bag-making packaging machine 10 is viewed from the front. The terms "upstream" and "downstream" of the bag-making packaging machine 10 indicate upstream and downstream in the direction of transport of a film F.

The bag-making packaging machine 10 according to the present embodiment produces a bag (hereinafter, "gusset bag") B2 shown in FIG. 1B. FIG. 1B is a perspective view of the gusset bag B2. The gusset bag B2 has four side parts F1 through F4 and one bottom part BB. The gusset bag B2 is a free-standing bag having the bottom part BB as a support plane. The gusset bag B2 is formed having folded-in parts (gussets) G, G; four hem parts H1 through H4; a longitudinal seal area L1; a top transverse seal area T1; and a bottom transverse seal area T2. The gusset bag B2 is formed so that a front and a back are made wider than two sides. In the present embodiment, the front of the gusset bag B2 is the side part F1 on which the longitudinal seal area L1 is formed among the four side parts F1 through F4.

Overall Configuration of Bag-Making Packaging Machine

Figure 1B:
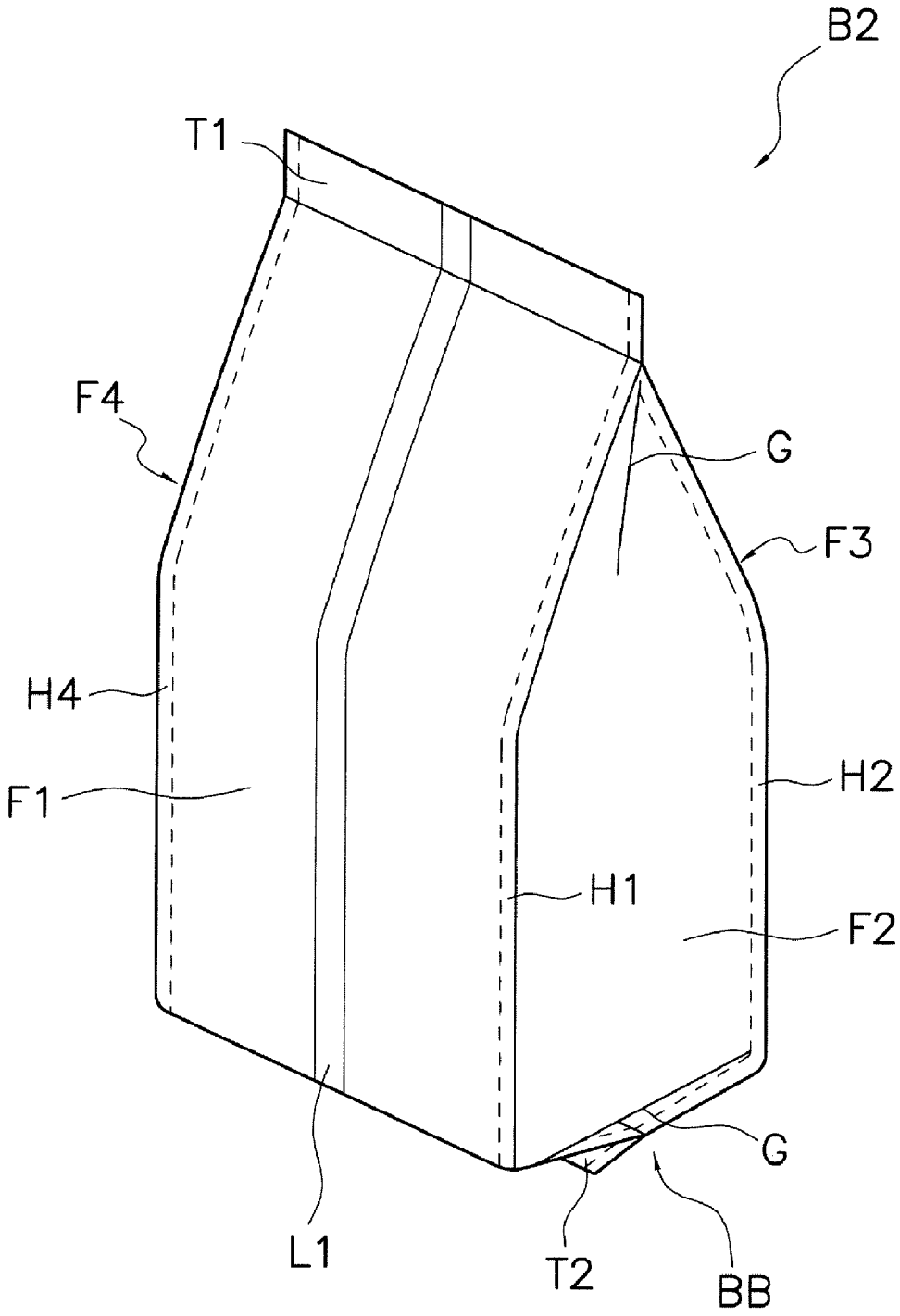
FIG. 1B is a perspective view showing a gusset bag that is produced by the bag-making packaging machine.

The overall configuration of the bag-making packaging machine 10 is described first with reference to FIG. 1A. The bag-making packaging machine 10 is a machine for packing a product such as a snack food into a bag. The bag-making packaging machine 10 primarily includes a bag-making packaging unit 6 for packing a product into a bag, and a film-feeding unit 5 for feeding a sheet-form film F to be made into a gusset bag B2 to the bag-making packaging unit 6. Operational switches 18 are disposed facing the front on the right side of the bag-making packaging unit 6. A liquid crystal display 19 for showing the operational state is disposed in a position that is visible to a user who operates the operational switches 18. The configuration of each part of the bag-making packaging machine 10 is described below.

1. Film-Feeding Unit

The film-feeding unit 5 is a unit for feeding a sheet-form film F to the bag-making packaging unit 6 to be described later. The film-feeding unit 5 feeds the sheet-form film F so as to be synchronous with operation of a pull-down belt mechanism 32 to be described later.

2. Bag-Making Packaging Unit

The bag-making packaging unit 6 loads a confectionery or other article being packaged, which was weighed by a combination weighing device 2 shown in FIG. 1A, while forming the sheet-form film F delivered from the film-feeding unit 5 into a polygonal tubular form, and forms a gusset bag B2. Hereafter, the sheet-form film F is deformed by each mechanism shown in FIGS. 2A and 2B into a polygonal tubular film Fm, a tubular bag B1, and finally a gusset bag B2.

The bag-making packaging unit 6 primarily includes a hem-forming mechanism 61, a molding mechanism 31, a pull-down belt mechanism 32, a longitudinal sealing mechanism 33, a gusset-forming mechanism 35, a transverse sealing mechanism 34, a seal orientation correcting mechanism 36 for correcting the orientation of a bottom transverse seal area, a bottom-forming mechanism 7, and a delivery mechanism 8.

1) Hem-Forming Mechanism

Figure 3:
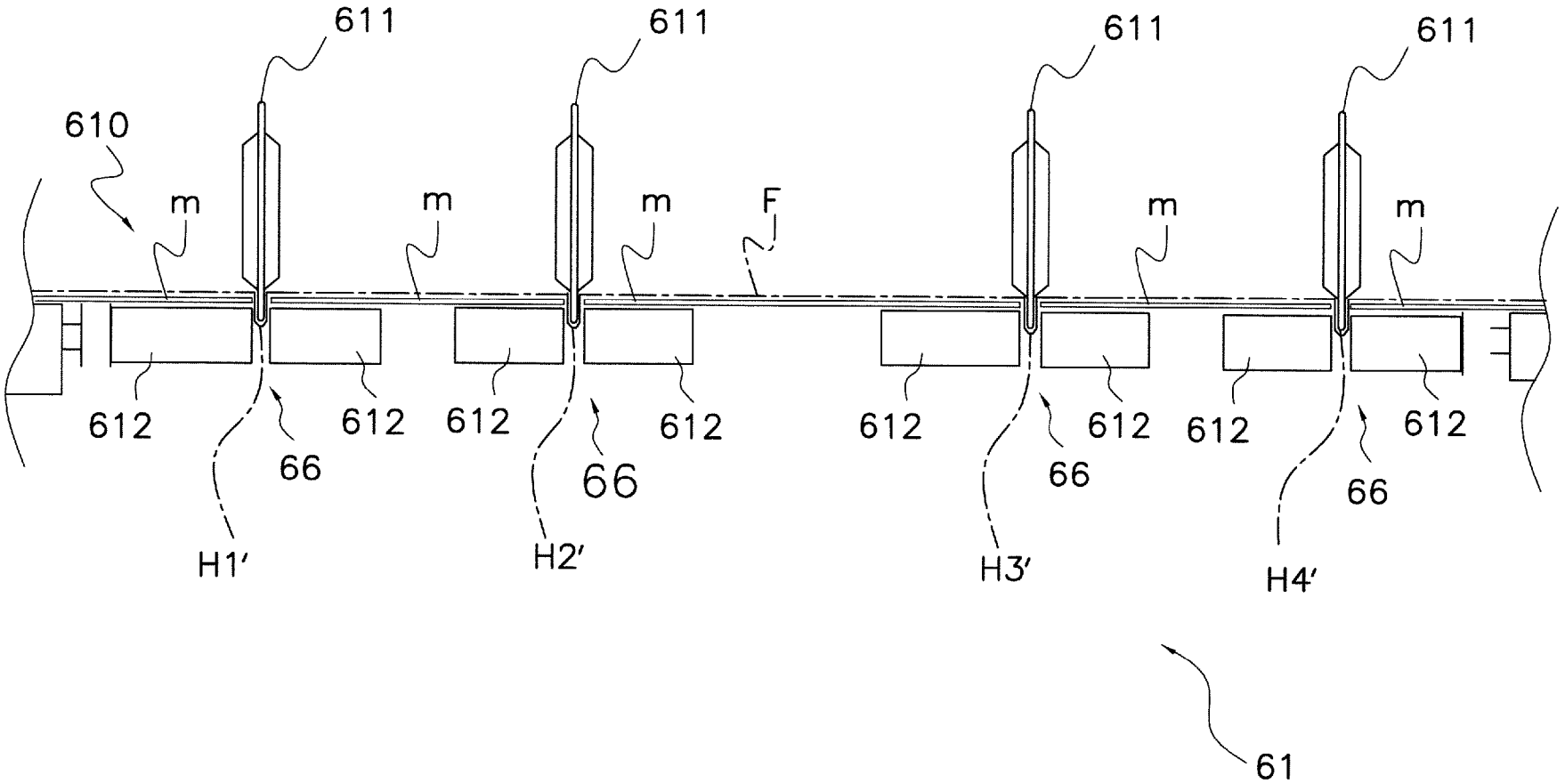
FIG. 3 is a cross-sectional view of a hem-forming mechanism.

The configuration of the hem-forming mechanism 61 is described first with reference to FIG. 3. FIG. 3 is a schematic cross-sectional view of the hem-forming mechanism 61.

The hem-forming mechanism 61 is configured to form hem parts H1 through H4 in the sheet-form film F. The hem-forming mechanism 61 is disposed between the film-feeding unit 6 and the molding mechanism 31 to be described later. Specifically, the hem-forming mechanism 61 is disposed in the region indicated by the double-dotted broken line R1 in FIG. 2B.

The hem-forming mechanism 61 primarily includes a transport plane 610, insertion members 611, heater blocks 612, and a plurality of pairs of rollers (not shown).

1-1) Transport Plane

The film F fed from the film-feeding unit 5 is delivered to the molding mechanism 31 to be described later while being kept in contact with the surface of the transport plane 610. The transport plane 610 includes a plurality of board-form members m, m, . . . that extend from upstream to downstream in the direction of transport of the film F. The plurality of board-form members m, m, . . . is arranged in the width direction of the film F. The plurality of board-form members m, m, . . . is disposed in prescribed positions separated by four narrow spaces 66, 66, 66, 66. Four long and slender slots that extend from upstream to downstream in the direction of transport of the film F can thereby be formed on the transport plane 610.

1-2) Insertion Members

The insertion members 611 are members that are inserted from above into the slots faulted on the above transport plane 610. Four insertion members 611 are disposed in the width direction of the film F. The film F passing in the vicinity of the slots on the transport plane 610 comes into contact with the insertion members 611 and is inserted into the slots. Parts H1' through H4' corresponding to hem parts are thereby formed on prescribed parts of the film F.

1-3) Heater Blocks

The heater blocks 612 are disposed on both sides in the length direction of the slots formed on the transport plane 610. The heater blocks 612 apply heat from both sides to the parts H1' through H4' corresponding to hem parts that are inserted into the slots of the transport plane 610 by the above insertion members 611.

1-4) Pairs of Rollers

Pairs of rollers (not shown) are disposed on the downstream side of the transport plane 610. The pairs of rollers sandwich from both sides the parts H1' through H4' corresponding to hem parts that are formed on the upstream side of the transport plane 610, and bond the opposite sides of the film F. Hem parts H1 through H4 are thereby formed on the sheet-form film F.

2) Molding Mechanism

The molding mechanism 31 is described next with reference to FIGS. 2A and 2B.

The molding mechanism 31 molds the sheet-form film F, on which the hem parts H1 through H4 are formed, into a tubular form. The molding mechanism 31 primarily includes a tube 31*a* and a former 31*b*.

2-1) Tube

The tube 31*a* is a polygonal tubular member and is open on the top and bottom ends. An article C to be packaged, which was weighed by the combination weighing device 2, is introduced into the opening on the top end of the tube 31*a*. Guides 312, 312, . . . are provided at the opening on the bottom end of the tube 31*a*. The guides 312, 312, . . . are members in the form of thin plates that extend in the downstream direction from four corners of the opening on the bottom end. The film F is transported in the downstream direction along the surface of the tube 31*a*.

2-2) Former

The former 31*b* is disposed so as to surround the tube 31*a*. The shape of the former 31*b* is such that the sheet-form film F is formed into a tubular form when passing between the former 31*b* and the tube 31*a*.

3) Pull-Down Belt Mechanism

The pull-down belt mechanism 32 is described next with reference to FIGS. 2A and 2B.

The pull-down belt mechanism 32 continuously transports a film F that has been made into tubular form (hereinafter, "polygonal tubular film Fm"). The pull-down belt mechanism 32 is a mechanism for attaching and continuously transporting downward the polygonal tubular film Fm wrapped on the tube 31*a*.

The pull-down belt mechanism 32 primarily includes a belt 32*a*, a drive roller 32*b*, a follower roller 32*c*, and a roller drive motor (not shown).

Belts 32*a* are provided on both the left and right sides of the tube 31*a*, holding the tube in between. The belts 32*a* hold the polygonal tubular film Fm in contact with the belts.

3-2) Drive Roller, Follower Roller, and Roller Drive Motor

The drive roller 32*b* is rotated by a roller drive motor (not shown). The follower roller 32*c* rotates in response to the rotation of the drive roller 32*b*. The above belt 32*a* is rotated by the rotation of the drive roller 32*b* and the follower roller 32*c*. The polygonal tubular film Fm attached to the belt 32*a* is thereby delivered downstream.

4) Longitudinal Sealing Mechanism

The longitudinal sealing mechanism 33 is described next with reference to FIG. 2A.

The longitudinal sealing mechanism 33 is a mechanism for overheating the overlapping parts of the polygonal tubular film Fm wrapped on the tube 31*a*. The longitudinal sealing mechanism 33 is positioned on the front side of the tube 31*a*.

The longitudinal sealing mechanism 33 primarily includes a heater, a heater belt that is heated by the heater, and a driver for moving the heater belt closer to or further from the tube 31*a*. The longitudinal sealing mechanism 33 seals the overlapping parts of the polygonal tubular film Fm by pressing the overlapping parts of the polygonal tubular film Fm against the tube 31*a* with a constant pressure and overheating the overlapping parts using the heater. A longitudinal seal area L1 is thereby formed on the polygonal tubular film Fm.

5) Gusset-Forming Mechanism

The gusset-forming mechanism 35 is described next with reference to FIGS. 2A, 2B, 4, 5A, and 5B.

Figure 4:
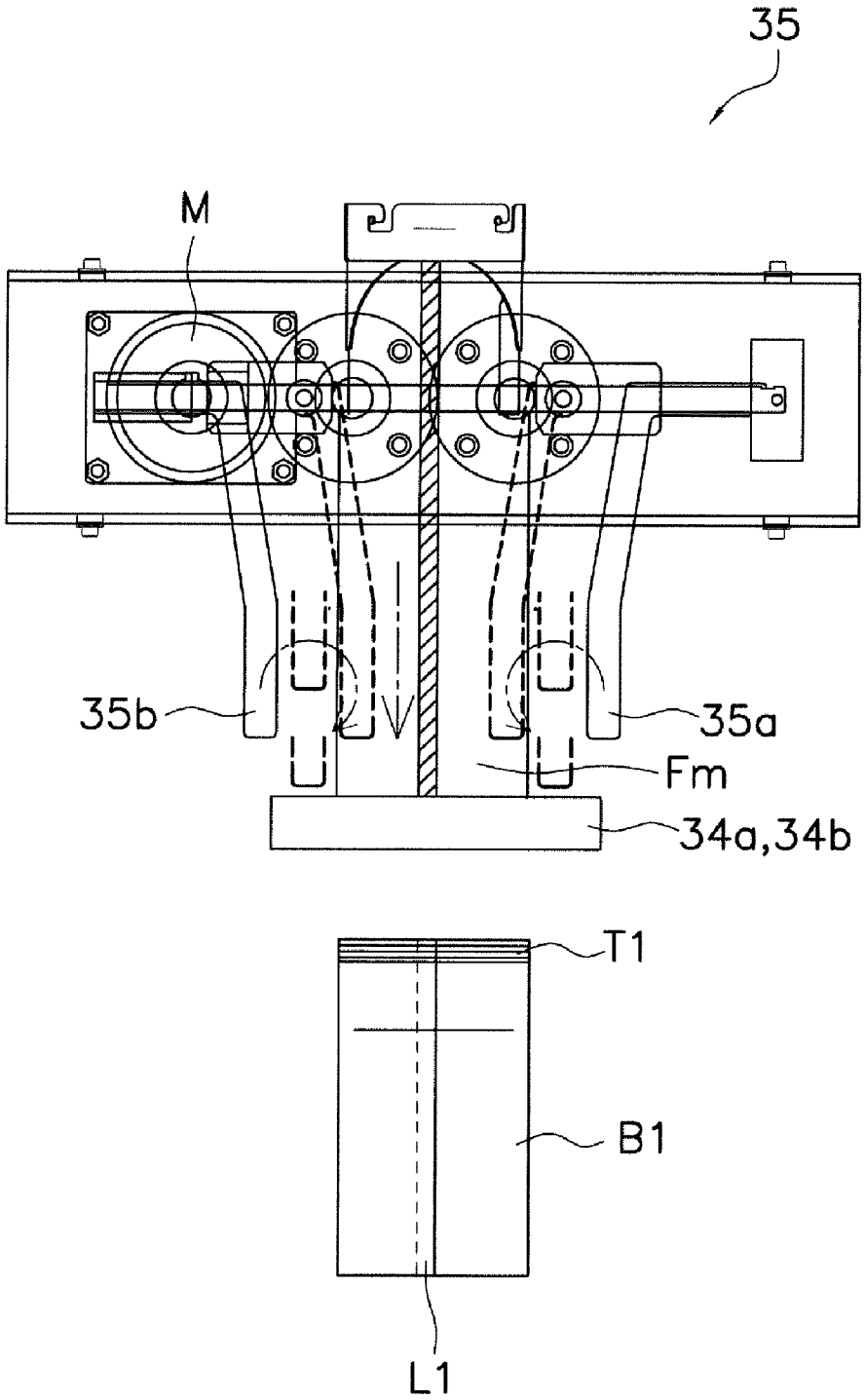
FIG. 4 is a front view showing the configuration of the periphery of the gusset-forming mechanism and the transverse sealing mechanism included in the bag-making packaging machine.

The gusset-forming mechanism 35 is a mechanism for forming gussets G, G on a gusset bag B2. As shown in FIGS. 2A and 2B, the gusset-forming mechanism 35 is disposed between the pull-down belt mechanism 32 described above and the transverse sealing mechanism 34 to be described later. As shown in FIG. 4, the gusset-forming mechanism 35 primarily includes folding-in members 35*a*, 35*b*, and a servo motor M.

Figure 5A:
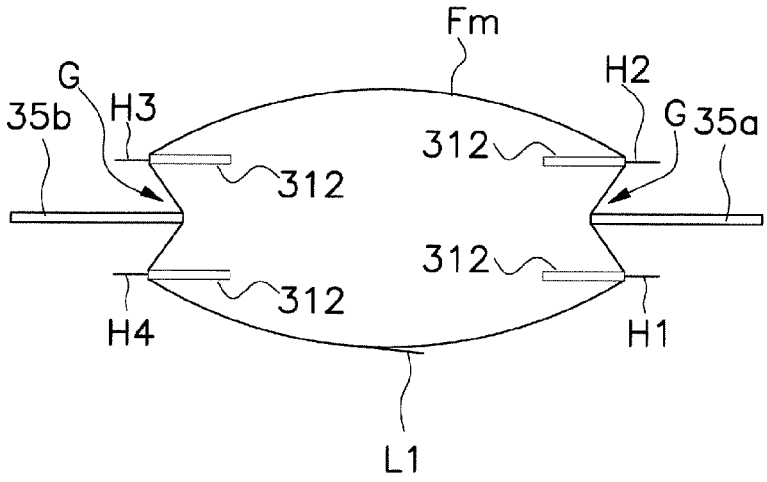
FIG. 5A is a plan view showing the state in which a folding-in member is pressed against a tubular film.
Figure 5B:
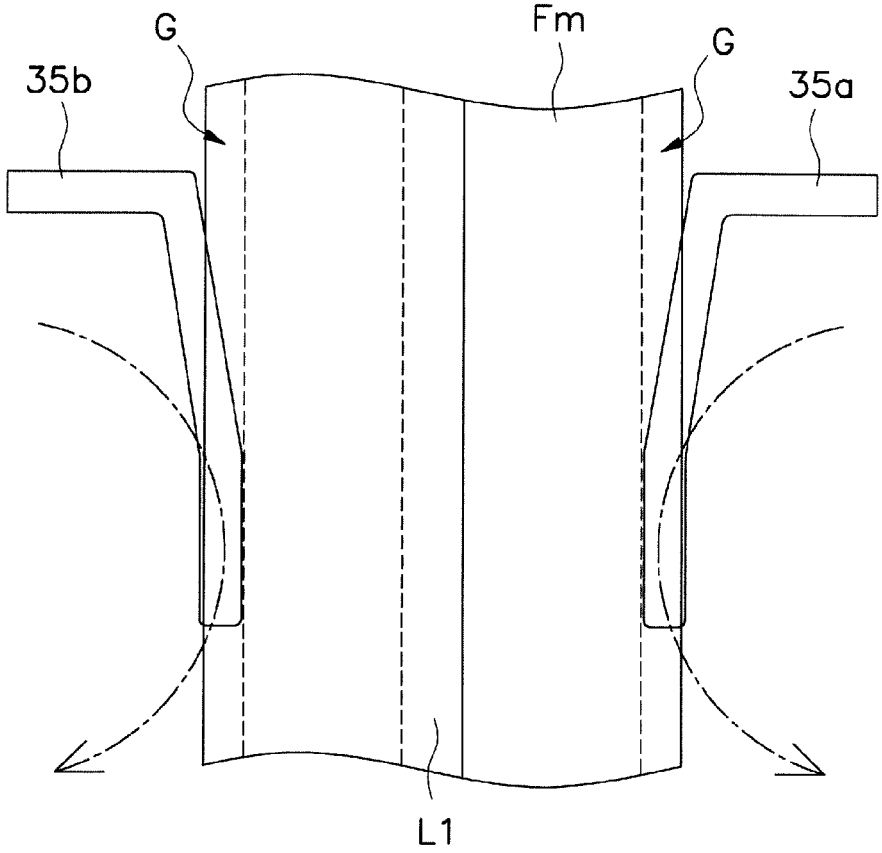
FIG. 5B is a front view showing the state in which the folding-in member is pressed against a tubular film.

The folding-in members 35*a*, 35*b* are thin plate-form members. A pair of folding-in members 35*a*, 35*b* is disposed on the left and right of the polygonal tubular film Fm, and holds the polygonal tubular film Fm in between. As shown in FIGS. 4 and 5B, the folding-in members 35*a*, 35*b* are moved along a roughly circular track by the driving of the servo motor M The folding-in members 35*a*, 35*b* are moved back and forth between an outside position that is furthest from the polygonal tubular film Fm and an inside position on the side opposite the outside position. The folding-in members 35*a*, 35*b* enter between the above guides 312, 312, . . . when moving to the inside position. Specifically, as shown in FIG. 5A, each of the folding-in members 35*a*, 35*b* respectively enters between two guides 312, 312. The polygonal tubular film Fm is thereby folded by the guides 312, 312, . . . and the folding-in members 35*a*, 35*b*, and the parts that are folded inward are made into gussets G, G.

6) Transverse Sealing Mechanism

The transverse sealing mechanism 34 is described next with reference to FIGS. 2A, 2B, 6, and 7. The transverse sealing mechanism 34 preferably constitutes a bag-producing part of the present embodiment.

The transverse sealing mechanism 34 transversely seals the polygonal tubular film Fm to close the top and the bottom ends of the bag B. As shown in FIGS. 2A and 2B, the transverse sealing mechanism 34 is disposed below the gusset-forming mechanism 35.

The transverse sealing mechanism 34 includes a pair of sealing jaws 34*a*, 34*b* having internal heaters. The pair of sealing jaws 34*a*, 34*b* approach and withdraw from each other. More specifically, the sealing jaws 34*a*, 34*b* revolve in synchronization with each other on D-shaped courses about the tube 31*a* as an axis (refer to FIG. 6). The sealing jaws 34*a*, 34*b* sandwich the polygonal tubular film Fm in the state of being closest to each other. The sealed parts of the polygonal tubular film Fm sandwiched by the sealing jaws 34*a*, 34*b* are heat-sealed by the internal heaters. The top transverse seal area T1 and the bottom transverse seal area T2 of the gusset bag B2 are thereby formed. One of the sealing jaws 34*a* has an internal cutter (not shown), and the center of the heat-sealed area is cut transversely by the cutter in a single cutting operation. The tubular bag B1 is thereby cut off from the longitudinally extending polygonal tubular film Fm.

Figure 7:
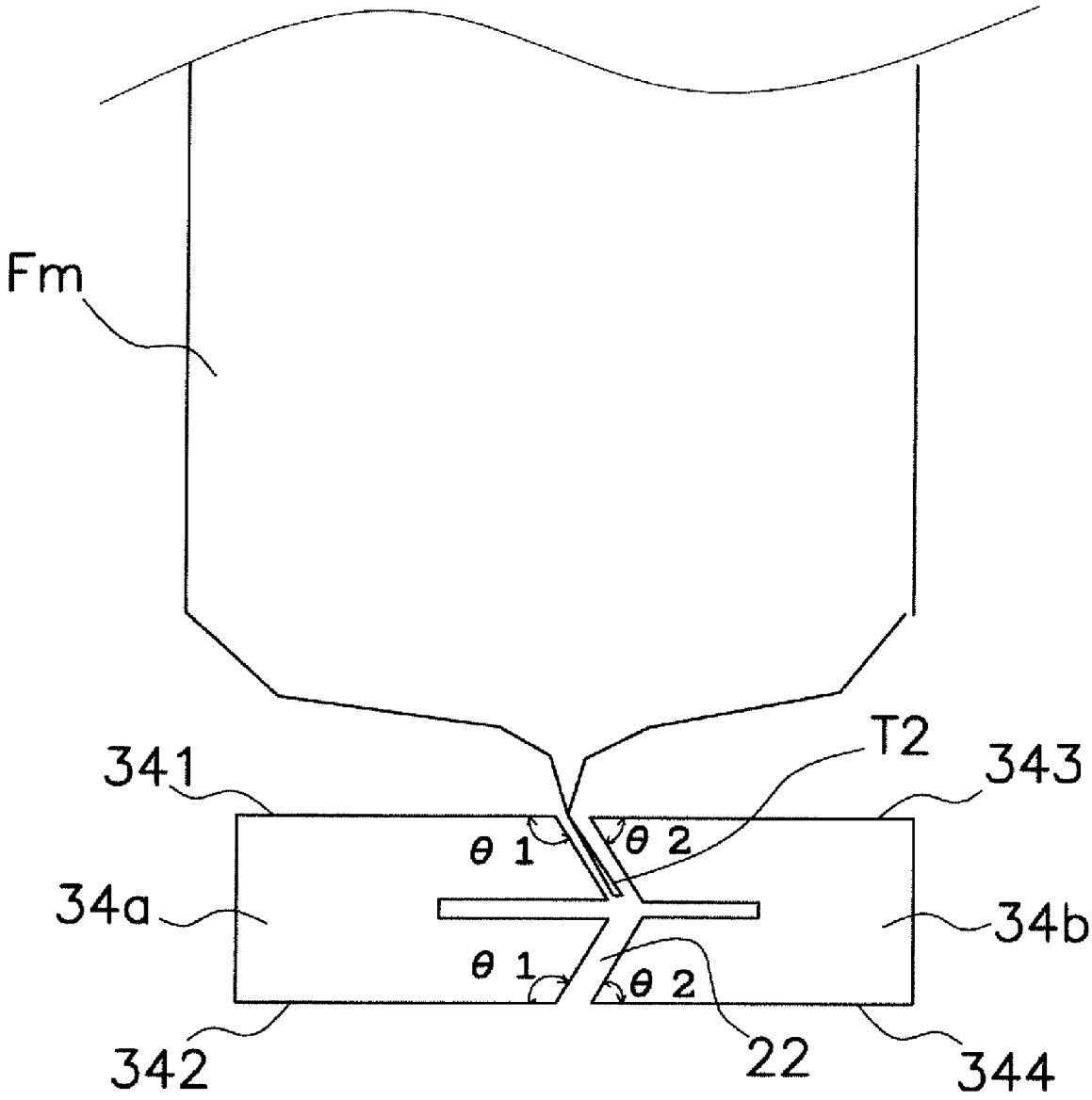
FIG. 7 is an enlarged view showing the pair of sealing jaws of the transverse sealing mechanism.

As shown in FIG. 7, the forward sealing jaw 34*a* has a projection in the center of the face disposed opposite the rear sealing jaw 34*b*. The rear sealing jaw 34*b* has a recess in the center of the face disposed opposite the forward sealing jaw 34*a*. Specifically, the side that extends from the top face 341 or bottom face 342 of the forward sealing jaw 34*a* is inclined, and the interior angles with the opposite faces are each equal to θ1 (110 to 120°). The side extending from the top face 343 or bottom face 344 of the rear sealing jaw 34*b* is inclined, and the interior angles with the opposite faces are each equal to θ2 (60 to 70°). A gap 22 that is V-shaped in cross section is formed between the opposite faces of the sealing jaws 34*a*, 34*b* by interlocking of the projected opposite face of the forward sealing jaw 34*a* and the recessed opposite face of the rear sealing jaw 34*b*. The transverse seal areas T1, T2 sandwiched in the gap 22 between the forward sealing jaw 34*a* and the rear sealing jaw 34*b* is therefore inclined in one direction.

7) Seal Orientation Correcting Mechanism

Figure 8:
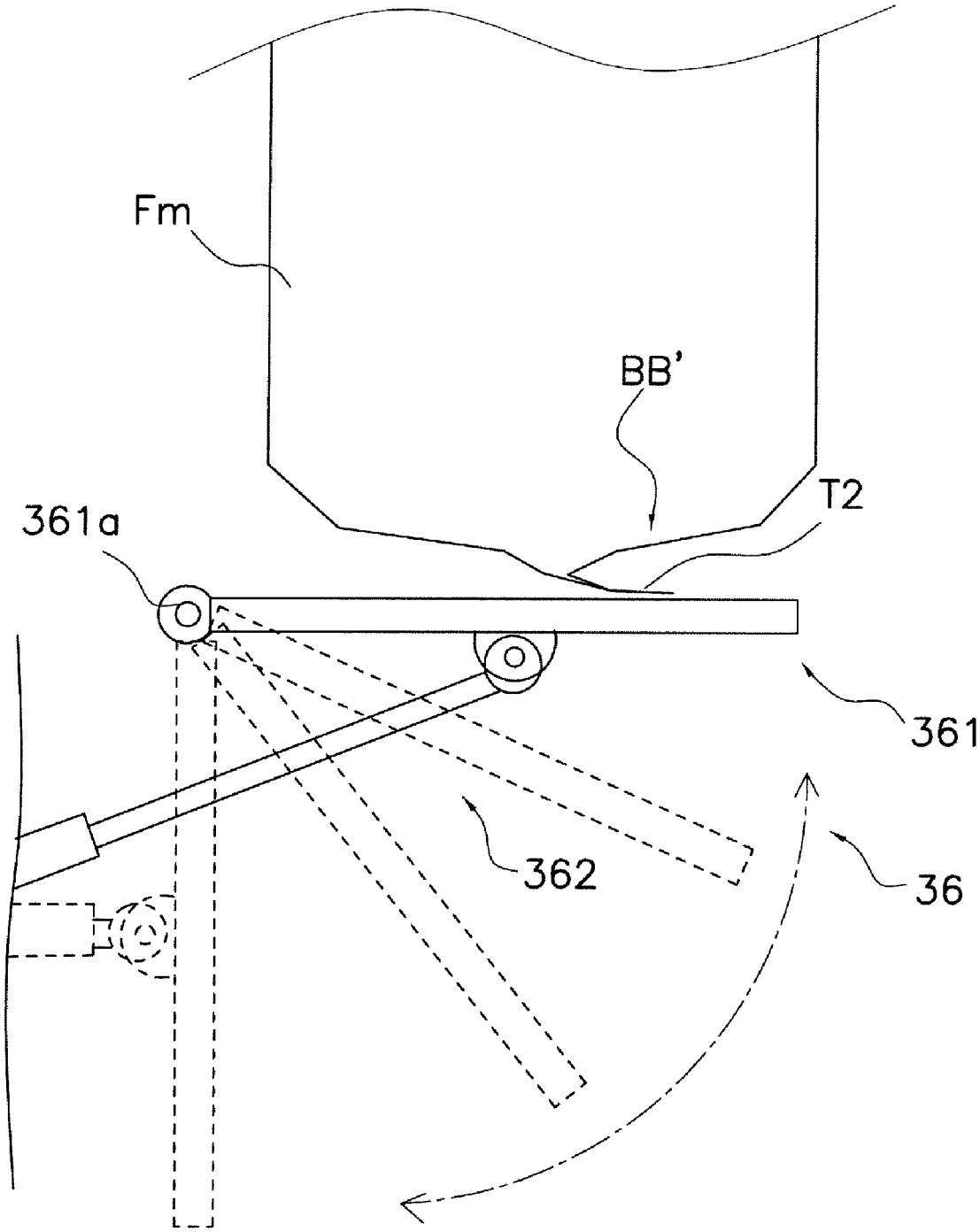
FIG. 8 is a view showing the operation of a seal orientation correcting mechanism for correcting the orientation of a bottom transverse seal area.

The seal orientation correcting mechanism 36 for correcting the orientation of a bottom transverse seal area is described next with reference to FIG. 8. FIG. 8 is a right side view of the seal orientation correcting mechanism 36.

The seal orientation correcting mechanism 36 is disposed downstream of the above transverse sealing mechanism 34. The seal orientation correcting mechanism 36 is a mechanism for creating contact with the bottom transverse seal area T2 so as to conform to the surface of the main body of the tubular bag B1 so that the bottom transverse seal area T2 is oriented generally parallel to a bottom surface of the main body of the tubular bag B1. More specifically, the seal orientation correcting mechanism 36 is a mechanism for bringing the bottom transverse seal area T2 into contact with a part of the main body of the tubular bag B1. "Main body" of the tubular bag B1 refers to all parts of the tubular bag B1 excluding the top transverse seal area T1 and the bottom transverse seal area T2. "Part of the main body" refers to a part BB' corresponding to a bottom part that is initially formed by the weight of the article being packaged.

The seal orientation correcting mechanism 36 for correcting the orientation of a bottom transverse seal area primarily includes a member 361 for pushing up a bottom transverse seal area, and a support member 362.

7-1) Member for Pushing Up a Bottom Transverse Seal Area

The member 361 for pushing up a bottom transverse seal area is a member in the form of a rectangular plate. The length in the long direction of the member 361 for pushing up a bottom transverse seal area is about equal to the width of the front surface and back surface of the tubular bag B1. The length in the short direction of the member 361 for pushing up a bottom transverse seal area is about equal to the width of the right side and left side of the tubular bag B1.

One end in the short direction of the member 361 for pushing up a bottom transverse seal area is fixed to a support shaft 361*a*. The support shaft 361*a* is attached to an internal frame (not shown) of the bag-making packaging unit 6 on the front side of the tubular bag B1. As shown in FIG. 8, the member 361 for pushing up a bottom transverse seal area is configured to be movable up and down about the support shaft 361*a*. The other end in the short direction of the member 361 for pushing up a bottom transverse seal area is movable about the support shaft 361*a*. That is, the member 361 for pushing up a bottom transverse seal area is moved up and down by the driving of the support member 362 to be described later, and comes into contact with the bottom transverse seal area T2 in the up position.

7-2) Support Member

The support member 362 is a member that supports the member 361 for pushing up a bottom transverse seal area from below. One end of the support member 362 also is attached to the internal frame (not shown) of the bag-making packaging unit 6. The other end of the support member 362 is attached to the bottom face of the member 361 for pushing up a bottom transverse seal area, that is, to the face on the side opposite the face that comes into contact with the bottom transverse seal area T2. The support member 362 has an extendable mechanism. The support member 362 extends and retracts at a prescribed timing by a motor (not shown). The "prescribed timing" is after the bottom transverse seal area T2 is formed and before the tubular bag B1 is cut off from the polygonal tubular film Fm. The support member 362 thereby causes the member 361 for pushing up a bottom transverse seal area to move up and down.

8) Bottom-Forming Mechanism

Figure 9:
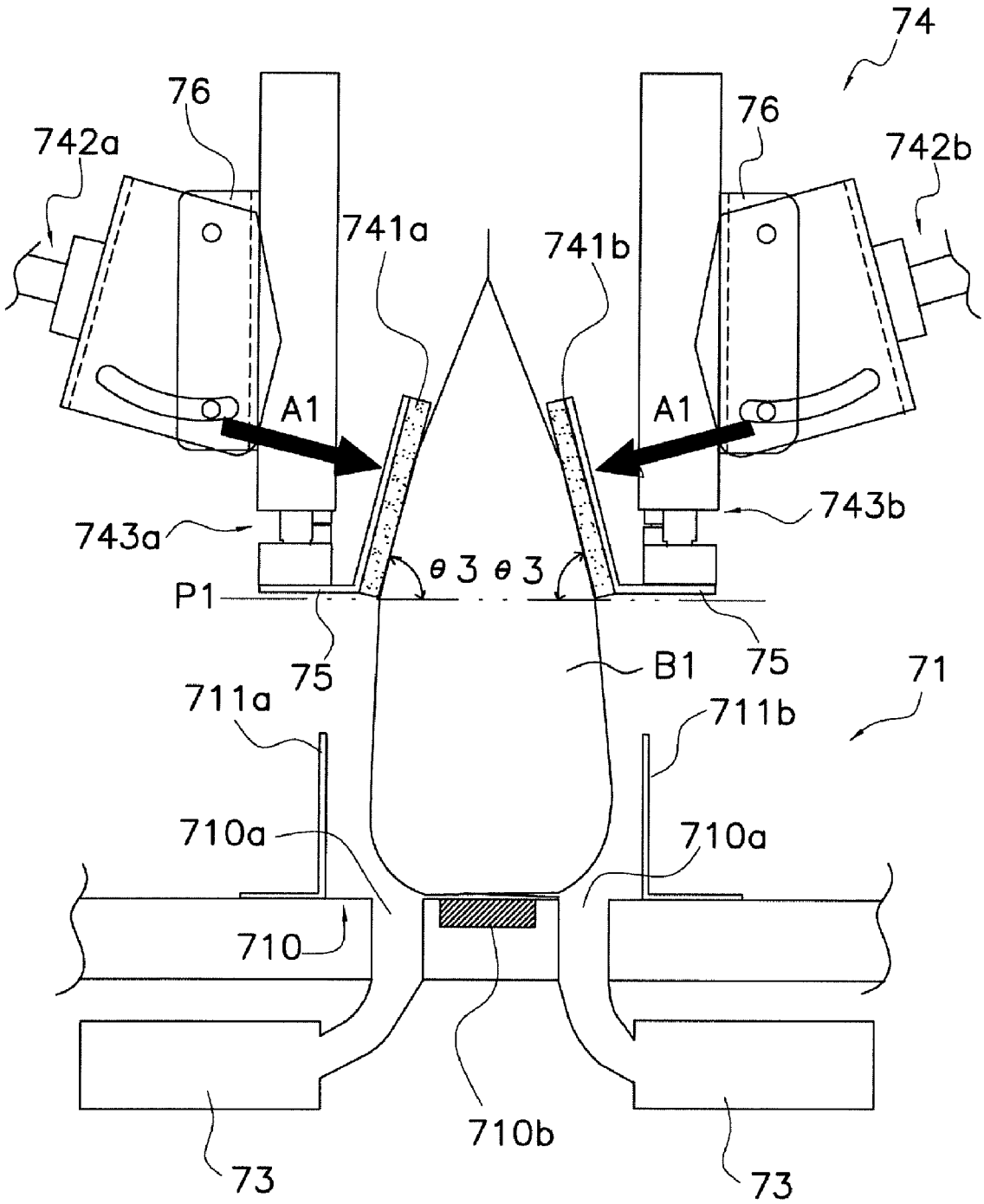
FIG. 9 is a view showing the state in which a forward/backward-moving cylinder moved contact members toward a tubular bag.
Figure 10:
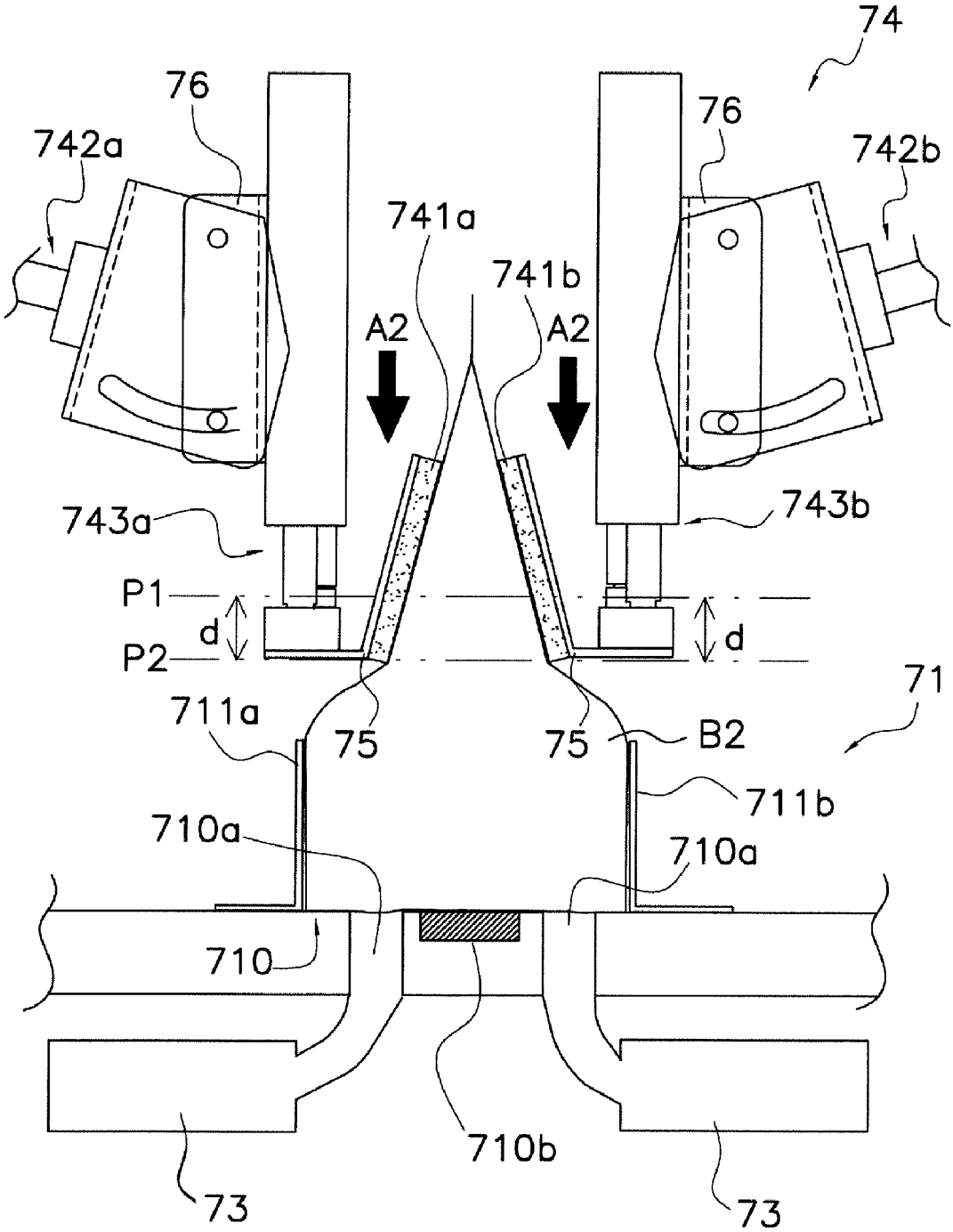
FIG. 10 is a view showing the state in which an upward/downward-moving cylinder moved the contact members downward.
Figure 11A:
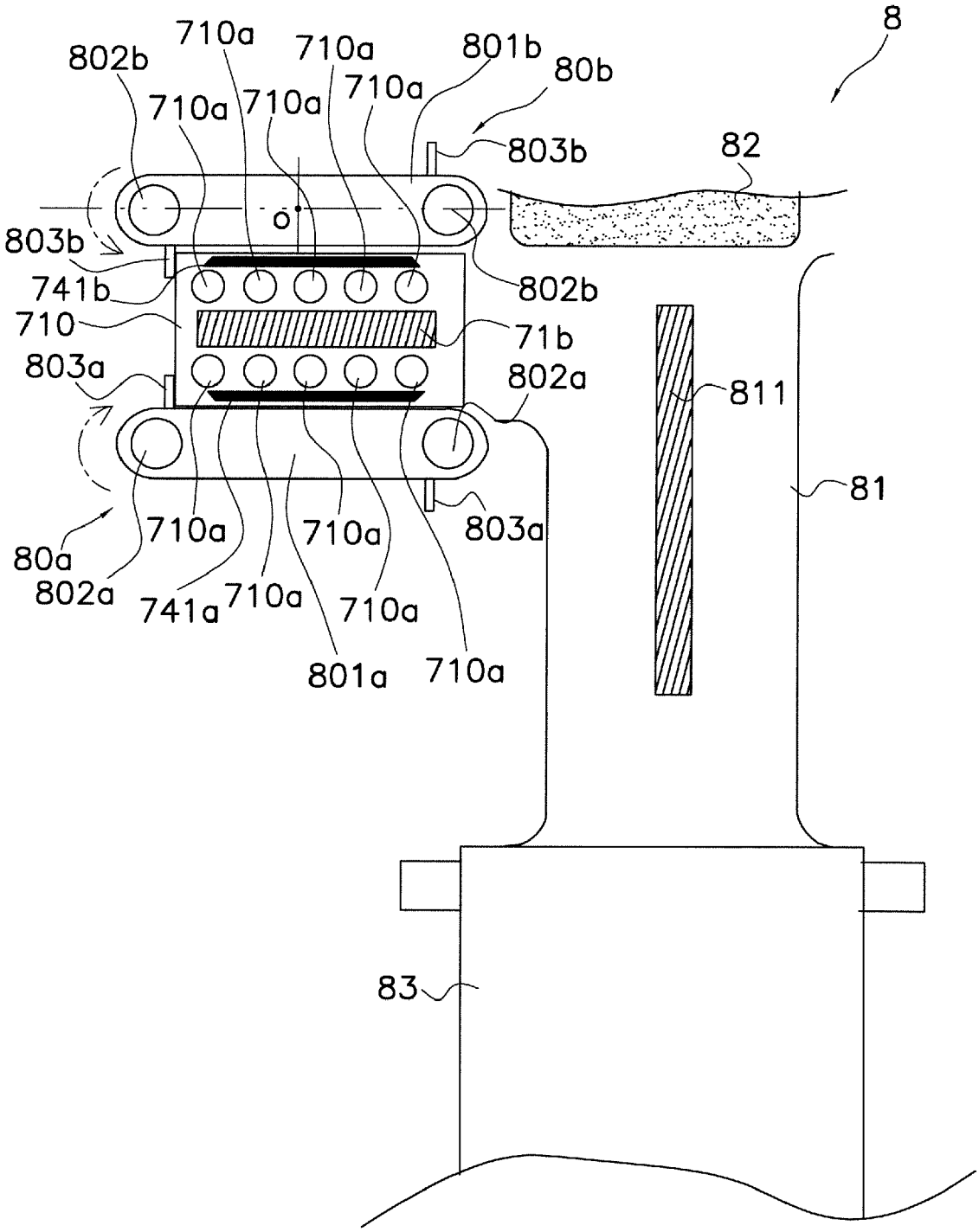
FIG. 11A is a view showing a delivery mechanism, as well as the bag receiving part and the contact member as components of the bottom-forming mechanism.

The bottom-forming mechanism 7 is described next with reference to FIGS. 9, 10, and 11A. FIGS. 9 and 10 are right side views of the bottom-forming mechanism 7. FIG. 11A is a view showing the bag receiving part 71 of the bottom-forming mechanism 7, and a delivery mechanism 8 to be described later.

The bottom-forming mechanism 7 is disposed downstream of the above transverse sealing mechanism 34 and adjusts the form of the tubular bag B1. Specifically, the bottom-forming mechanism 7 forms the following parts into a flat bottom part BB: the bottom transverse seal area T2 provided to the tubular bag B1, the part BB' corresponding to a bottom part of the tubular bag B1, and the main body disposed in the vicinity of the part BB' corresponding to a bottom part; and forms a gusset bag B2 having an appropriate rectangular bottom shape.

The bottom-forming mechanism 7 primarily includes a bag receiving part 71, vacuum devices 73, 73 (vacuum mechanism), and a pressing mechanism 74. The vacuum devices 73, 73 and the pressing mechanism 74 preferably constitute a bottom forming part of the present embodiment.

8-1) Bag Receiving Part

The bag receiving part 71 is disposed below the seal orientation correcting mechanism 36, and receives and holds the tubular bag B1 that has been cut off and dropped from the polygonal tubular film Fm by the transverse sealing mechanism 34. The bag receiving part 71 forms a horizontal plane 710 that receives and holds the tubular bag B1 dropped from above, and vertical planes 711*a*, 711*b* that rise perpendicularly from the horizontal plane 710.

8-1-1) Horizontal Plane

The horizontal plane 710 is a plate formed by a plate member that is made of material having high thermal conductivity. An example of a material having high thermal conductivity is aluminum. The horizontal plane 710 has a rectangular shape. The length in the long direction of the horizontal plane 710 is about equal to the width of the front surface and back surface of the tubular bag B1. The length in the short direction of the horizontal plane 710 is about equal to the width of the right side and left side of the tubular bag B1. The bottom transverse seal area T2, and a part (part BB' corresponding to a bottom part) of the main body of the tubular bag B1 come into contact with the horizontal plane 710. A heater 710*b* that extends in the long direction of the horizontal plane 710 is provided in the center of the horizontal plane 710. The heater 710*b* is switched to ON before the tubular bag B1 drops onto the horizontal plane 710, and is switched to OFF after a force is applied to the tubular bag B1 by upward/downward-moving cylinders 743*a*, 743*b* to be described later. The weight of the article being packaged contained in the tubular bag B1 and the downward force of the pressing mechanism 74 to be described later are applied to the bottom transverse seal area T2 and the part BB' corresponding to a bottom part. The bottom transverse seal area T2 and the part BB' corresponding to a bottom part are thereby thermally fused.

A plurality of holes 710*a*, 710*a*, . . . is formed on the horizontal plane 710. Specifically, as shown in FIG. 11A, the plurality of holes 710*a*, 710*a*, . . . is formed in two rows in the long direction. More specifically, the two rows of holes 710*a*, 710*a*, . . . arranged in the long direction are disposed one row each substantially horizontally on both sides of the above-described heater 710*b*.

8-1-2) Vertical Planes

The vertical planes 711*a*, 711*b* include a front-side vertical plane 711*a*, that faces the front surface of the tubular bag B1, and a back-side vertical plane 711*b*, that faces the back surface of the tubular bag B1. As described above, the vertical planes 711*a*, 711*b* rise perpendicularly from the horizontal plane 710. That is, the front-side vertical plane 711*a* rises perpendicularly from the front side of the horizontal plane 710, and the back-side vertical plane 711*b* rises perpendicularly from the back side of the horizontal plane 710.

8-2) Vacuum Devices

The vacuum devices 73, 73 suction the part BB' corresponding to a bottom part, and also draw the main body in the vicinity of the part BB' corresponding to a bottom part via the plurality of holes 710*a*, 710*a*, . . . provided on the above horizontal plane 710 by suction. The vacuum devices 73, 73 are provided in accordance with the number of rows of the plurality of holes 710*a*, 710*a*. That is, as shown in FIGS. 9 and 10, one vacuum device 73 is connected to the row of the plurality of holes 710*a*, 710*a*, . . . disposed on the front side of the tubular bag B1, and one vacuum device 73 is connected also to the row of the plurality of holes 710*a*, 710*a*, . . . disposed on the back side of the tubular bag B1. Since the part BB' of the bag B1 is drawn toward the horizontal plane 710 via the plurality of holes 710*a*, 710*a*, . . . , the bag B1 can be drawn in a wide range.

The vacuum devices 73, 73 are switched to ON before the tubular bag B1 drops onto the horizontal plane 710, and are switched to OFF after a downward force is applied to the tubular bag B1 by the upward/downward-moving cylinders 743*a*, 743*b* to be described later. The parts of the tubular bag B1 positioned above the plurality of holes 710*a*, 710*a*, . . . and in the vicinity of the plurality of holes 710*a*, 710*a*, . . . are thereby drawn toward the horizontal plane 710 via the plurality of holes 710*a*, 710*a*, . . . , and are made to adhere closely to the horizontal plane 710 when the tubular bag B1 drops onto the horizontal plane 710.

8-3) Pressing Mechanism

The pressing mechanism 74 is a mechanism for pressing the tubular bag B1 to the bag receiving part 71. The pressing mechanism 74 primarily includes contact members 741*a*, 741*b* (first and second members), and moving units 742*a*, 742*b*, 743*a*, 743*b* (first and second moving units).

8-3-1) Contact Members

The contact members 741*a*, 741*b* are rectangular flat plate members having a width about equal to the width of the front surface and back surface of the tubular bag B1. The contact members 741*a*, 741*b* include a front-side contact member 741*a* capable of coming into contact with the front of the tubular bag B1, and a back-side contact member 741*b* capable of coming into contact with the back of the tubular bag B1. As shown in FIG. 9, the front-side contact member 741*a* and the back-side contact member 741*b* are each inclined at a prescribed angle θ3 with respect to the tubular bag B1.

8-3-2) Moving Units

The moving units 742*a*, 742*b*, 743*a*, 743*b* move the contact members 741*a*, 741*b*, bring the contact members 741*a*, 741*b* into contact with the top of the main body of the tubular bag B1 to apply force, and move the contact members 741*a*, 741*b* away from the bag.

The moving units 742*a*, 742*b*, 743*a*, 743*b* include forward/backward-moving cylinders 742*a*, 742*b* for moving the contact members 741*a*, 741*b* forward and backward with respect to the tubular bag B1, and upward/downward-moving cylinders 743*a*, 743*b* for moving the contact members 741*a*, 741*b* upward and downward with respect to the tubular bag B1.

The forward/backward-moving cylinders 742*a*, 742*b* include a front-side forward/backward-moving cylinder 742*a* disposed on the front side of the tubular bag B1, and a back-side forward/backward-moving cylinder 742*b* disposed on the back side of the tubular bag B1. The upward/downward-moving cylinders 743*a*, 743*b* include a front-side upward/downward-moving cylinder 743*a* disposed on the front side of the tubular bag B1, and a back-side upward/downward-moving cylinder 743*b* disposed on the back side of the tubular bag B1.

The forward/backward-moving cylinders 742*a*, 742*b* are fixed via connection members 76, 76 to the upward/downward-moving cylinders 743*a*, 743*b* to be described later. Specifically, the front-side forward/backward-moving cylinder 742*a* is fixed via a connection member 76 to the front-side upward/downward-moving cylinder 743*a*, and the back-side forward/backward-moving cylinder 742*b* is fixed via a connection member 76 to the back-side upward/downward-moving cylinder 743*b*.

The forward/backward-moving cylinders 742*a*, 742*b* extend in the directions indicated by arrows A1, A1 in FIG. 9, and retract in the directions opposite the directions indicated by arrows A1, A1. The forward/backward-moving cylinders 742*a*, 742*b* thereby cause the contact members 741*a*, 741*b* to come into contact with and withdraw from the top of the main body of the tubular bag B1 via the upward/downward-moving cylinders 743*a*, 743*b*.

In the case when the forward/backward-moving cylinders 742*a*, 742*b* extend in the directions indicated by arrows A1, A1, that is, in the case when the forward/backward-moving cylinders 742*a*, 742*b* have moved the contact members 741*a*, 741*b* forward, the contact faces of the contact members 741*a*, 741*b* come into contact with the front and back of the tubular bag B1 and correct the orientation of the tubular bag B1.

The upward/downward-moving cylinders 743*a*, 743*b* are fixed to the contact members 741*a*, 741*b* via support members 75, 75 for supporting the above contact members 741*a*, 741*b*. Specifically, the front-side upward/downward-moving cylinder 743*a* is fixed to the front-side contact member 741*a* via a support member 75. The back-side upward/downward-moving cylinder 743*b* is fixed to the back-side contact member 741*b* via a support member 75.

The upward/downward-moving cylinders 743*a*, 743*b* extend in the directions indicated by arrows A2, A2 in FIG. 10, and retract in the directions opposite the directions indicated by arrows A2, A2. The upward/downward-moving cylinders 743*a*, 743*b* thereby move the contact members 741*a*, 741*b* upward and downward. More specifically, the upward/downward-moving cylinders 743*a*, 743*b* move the bottom ends of the contact members 741*a*, 741*b* from the upward position P1 shown in FIGS. 9 and 10 to the downward position P2 shown in FIG. 10. The distance d between the upward position P1 and the downward position P2 is about 1 cm. The upward/downward-moving cylinders 743*a*, 743*b* apply a downward pressure to the front and back of the tubular bag B1 via the contact members 741*a*, 741*b* when the bottom ends of the contact members 741*a*, 741*b* are in the downward position P2. The shape of the tubular bag B1 is thereby deformed so as to conform to the shape of the above bag receiving part 71. That is, the bottom transverse seal area T2, the part BB' corresponding to a bottom part, and the main body in the vicinity of the part BB' corresponding to a bottom part of the tubular bag B1 are deformed by the upward/downward-moving cylinders 743*a*, 743*b* so as to adhere closely to the horizontal plane 710, the front-side vertical plane 711*a*, and the back-side vertical plane 711*b*. A bottom part BB is thereby formed on the tubular bag B1, and a gusset bag B2 having a desired rectangular bottom shape is formed.

9) Delivery Mechanism

The delivery mechanism 8 is described next with reference to FIG. 2B and FIGS. 11A through 11H. FIGS. 11A through 11H are plan views showing the horizontal plane 710 and the contact members 741*a*, 741*b* of the bottom-forming mechanism 7, and the delivery mechanism 8. The delivery mechanism 8 is a mechanism for delivering a gusset bag B2, which is a tubular bag B1 on which a bottom part BB was formed by the bottom-forming mechanism 7, to a packing stage. As shown in FIGS. 11A through 1111, the gusset bag B2 is transported on a roughly L-shaped course.

The delivery mechanism 8 primarily includes delivery parts 80*a*, 80*b*, a intermediate path 81, a discharge pusher 82, and a belt conveyer 83.

9-1) Delivery Parts

The delivery parts 80*a*, 80*b* deliver the gusset bag B2 from the bag receiving part 71 to the intermediate path 81 to be described later. The delivery parts 80*a*, 80*b* include a front-side delivery part 80*a* positioned on the front side of the gusset bag B2, and a bag-side delivery part 80*b* positioned on the back side of the gusset bag B2. The delivery parts 80*a*, 80*b* deliver the gusset bag from the bag receiving part 71 to the intermediate path 81 using both the front-side delivery part 80*a* and the back-side delivery part 80*b*.

The delivery parts 80*a*, 80*b* primarily comprise pairs of belts 801*a*, 801*b*; rollers 802*a*, 802*a*, 802*b*, 802*b* for driving each belt 801*a*, 801*b*; and fins 803*a*, 803*a*, 803*b*, 803*b* attached to the surface of each belt 801*a*, 801*b*, that is, to the contact face contacted by the gusset bag B2. Specifically, the delivery part 80*a* positioned on the front side of the gusset bag B2 includes the belt 801*a*, the rollers 802*a*, 802*a* for driving the belt 801*a*, and the fins 803*a*, 803*a* attached to the contact face of the belt 801*a*. The delivery part 80*b* positioned on the back side of the gusset bag B2 includes the belt 801*b*, the rollers 802*b*, 802*b* for driving the belt 801*b*, and the fins 803*b*, 803*b* attached to the contact face of the belt 801*b*.

9-1-1) Belts

Figure 2A:
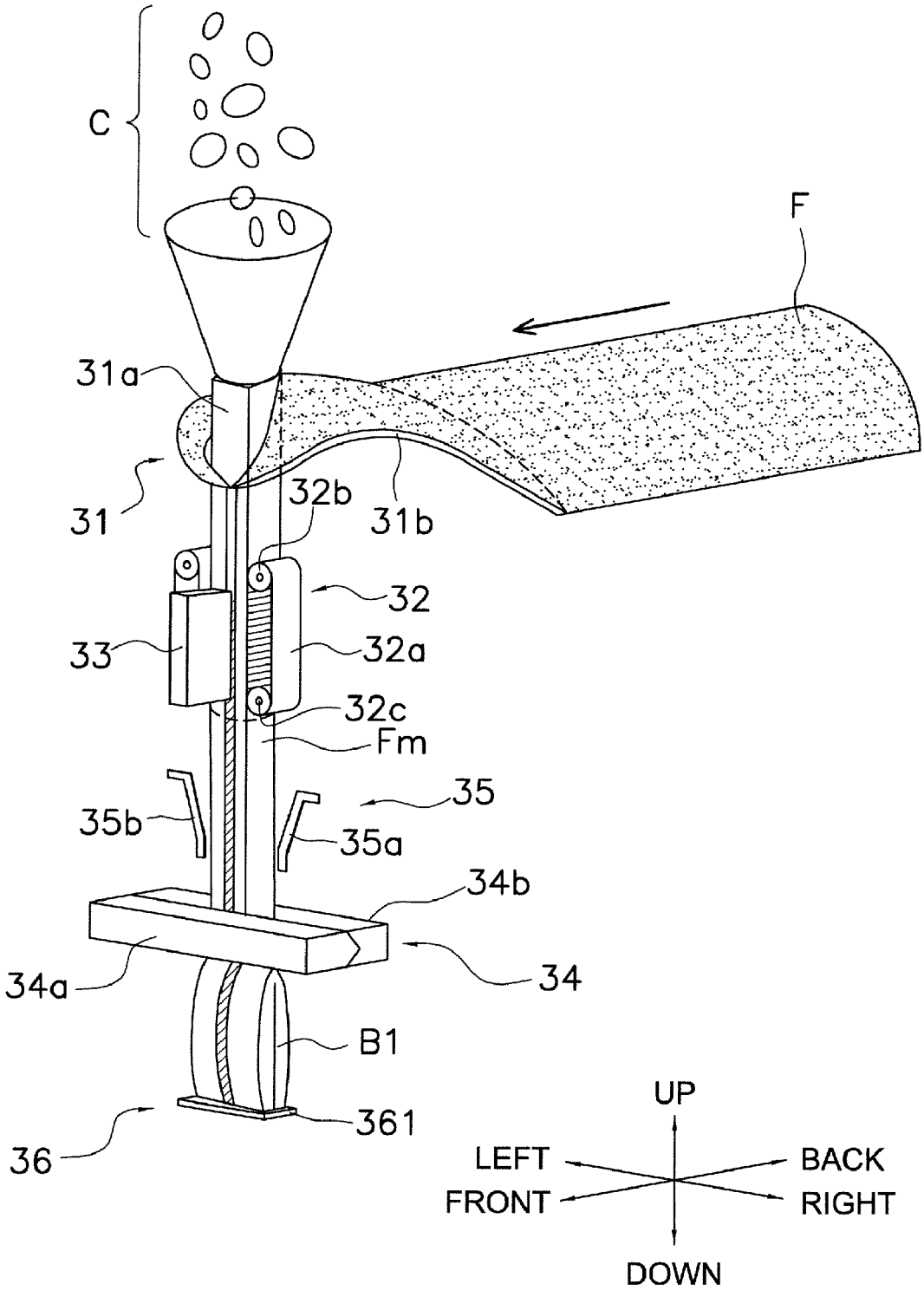
FIG. 2A is a schematic perspective view showing the configuration of a molding mechanism, pull-down belt mechanism, longitudinal sealing mechanism, transverse sealing mechanism, and gusset-forming mechanism included in the bag-making packaging machine in FIG. 1A.
Figure 2B:
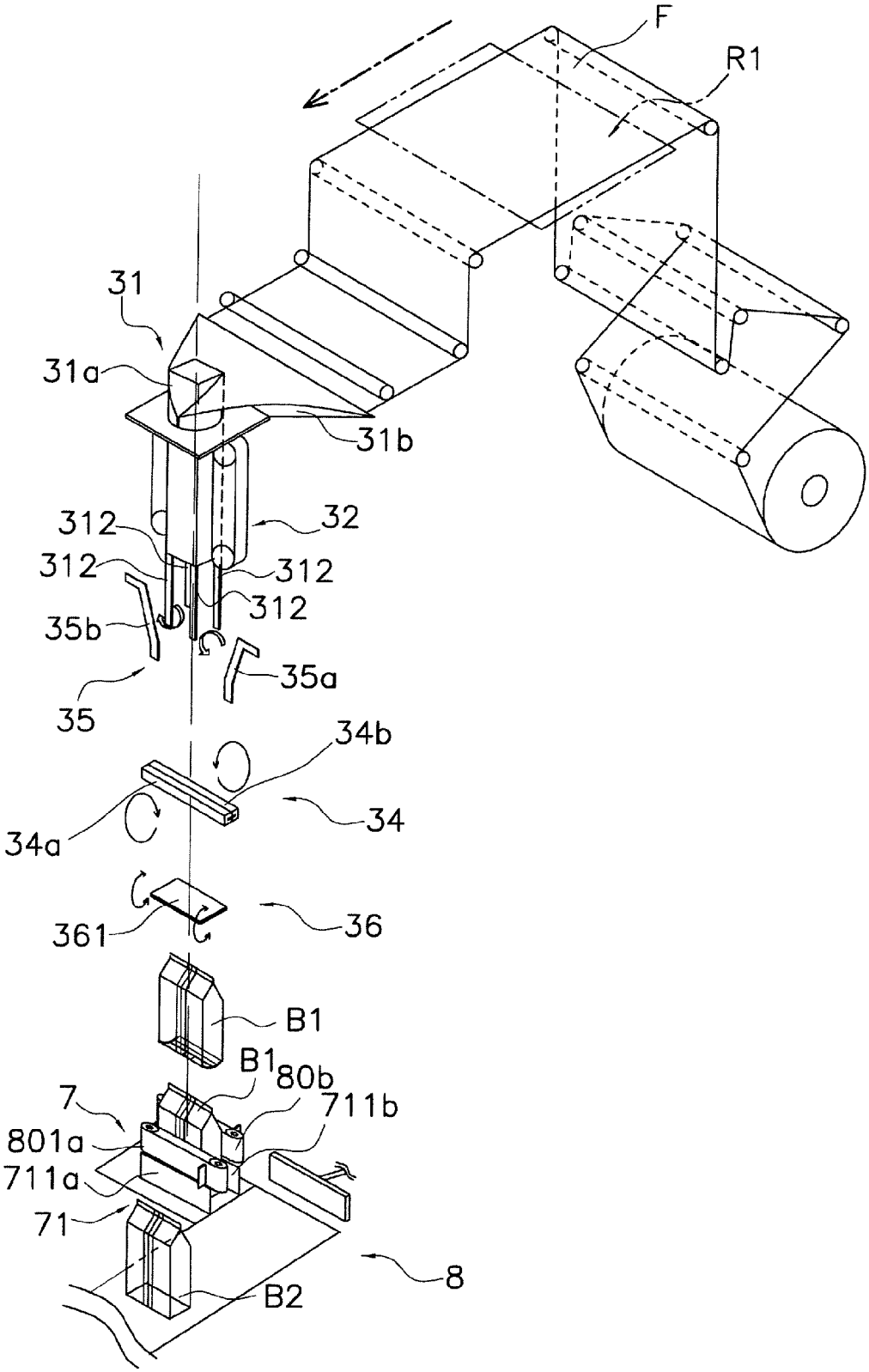
FIG. 2B is an exploded perspective view schematically showing the configuration of each member included in the bag-making packaging machine.

As shown in FIG. 2B, the belts 801*a*, 801*b* are disposed above the aforementioned vertical planes 711*a*, 711*b* so as to sandwich the gusset bag B2. Specifically, the belts 801*a*, 801*b* are disposed respectively on the front side and back side of the gusset bag B2. More specifically, the belt 801*a* is disposed on the front side of the gusset bag B2, and the belt 801*b* is disposed on the back side of the gusset bag B2. The belts 801*a*, 801*b* have a length about equal to the width of the front and back of the gusset bag B2.

9-1-2) Rollers

As shown in FIGS. 11A through 11H, the rollers 802*a*, 802*a*, 802*b*, 802*b* are disposed on the insides of the aforementioned belts 801*a*, 801*b*. Specifically, the rollers 802*a*, 802*a* are provided on the inside of the belt 801*a* disposed on the front side of the gusset bag B2. The rollers 802*b*, 802*b* are provided on the inside of the belt 801*b* disposed on the back side of the gusset bag B2. Either roller 802*a* of the two rollers 802*a*, 802*a* disposed on the inside of one belt 801*a* is driven by a roller drive motor (not shown). The other roller 802*a* rotates together with the rotation of the one roller 802*a*. The above belts 801*a*, 801*b* are moved by the rotation of the rollers 802*a*, 802*a*, 802*b*, 802*b*. The rollers 802*a*, 802*a* that rotate the belt 801*a* disposed on the front side of the gusset bag B2, and the rollers 802*b*, 802*b* that rotate the belt 801*b* disposed on the back side of the gusset bag B2 rotate in synchronization. The aforementioned belts 801*a*, 801*b* are also moved in synchronization thereby.

9-1-3) Fins

Two fins 803*a*, 803*a*, 803*b*, 803*b* respectively are attached on the contact faces of the aforementioned belts 801*a*, 801*b* that contact with the gusset bag B2. Specifically, the fins 803*a*, 803*a* are attached on the contact face of the belt 801*a* disposed on the front side of the gusset bag B2, and the fins 803*b*, 803*b* are attached on the contact face of the belt 801*b* disposed on the back side of the gusset bag B2.

The two fins 803*a*, 803*a*, 803*b*, 803*b* attached to each of the belts 801*a*, 801*b* are disposed on the contact faces of the belts 801*a*, 801*b* so as to be in mutually point-symmetric positions. Specifically, as shown in the back-side delivery part 80*b* in FIG. 11A, the fins 803*b*, 803*b* are disposed in positions that are symmetric with respect to the center point O of the delivery part 80*b*. Therefore in the case when one fin 803*a*, 803*b* of the two fins 803*a*, 803*a*, 803*b*, 803*b* is in contact with the gusset bag B2, the other fin 803*a*, 803*b* does not contact the gusset bag B2. The belts 801*a*, 801*b* move in synchronization. One fin 803*a*, 803*b* of each of the belts 801*a*, 801*b* (hereinafter, "pair of fins 803*a*, 803*b*") thus comes into contact with the gusset bag B2, and the pair of fins 803*a*, 803*b* begins to push the gusset bag B2. The gusset bag B2 is thereby delivered to the upstream side of the adjacent intermediate path 81. The gusset bag B2 is delivered from the horizontal plane 710 to the intermediate path 81 in a state in which the front is oriented toward the belt conveyer 83 to be described later, and stands upright on one end of the upstream side of the intermediate path 81.

9-2) Intermediate Path

The intermediate path 81 is a course or path for connecting the bottom-forming mechanism 7 and the belt conveyer 83. Specifically, the intermediate path 81 is used for conveying the gusset bag B2 delivered from the bottom-forming mechanism 7 by the delivery parts 80*a*, 80*b* to the belt conveyer 83 to be described later.

The intermediate path 81 is a rectangular plate that extends from upstream to downstream. The plate is made of material (for example, aluminum) having high thermal conductivity. One end on the upstream side of the intermediate path 81 is connected to the bottom-forming mechanism 7. One end on the downstream side of the intermediate path 81 is connected to the belt conveyer 83. That is, the end on the upstream side of the intermediate path 81 is connected in a straight line from the bottom-forming mechanism 7, and the end on the downstream side of the intermediate path 81 is connected in a straight line to the belt conveyer 83. The course having one end on the upstream side of the intermediate path 81 connected from the bottom-forming mechanism 7 corresponds to the bottom portion of the roughly L-shaped course on which the gusset bag B2 is transported.

The height of the end of the transport plane on the upstream side of the intermediate path 81 is about equal to the horizontal plane 710 of the bottom-forming mechanism 7. The height of the end on the downstream side of the intermediate path 81 is about equal to the height of the end on the upstream side of the belt conveyer 83.

The intermediate path 81 has a heater 811 having a prescribed length in the long direction. The heater 811 is installed in the intermediate path 81. The heater 811 heats the bottom part BB of the gusset bag B2 delivered to the intermediate path 81. The position where the heater 811 is installed in the intermediate path 81 is preferably in the center in the width direction of the intermediate path 81. The heat of the heater 811 is thereby transferred widely across the entirety of the intermediate path 81.

9-3) Discharge Pusher

As shown in FIGS. 11A through 11H, the discharge pusher 82 is provided at one end on the upstream side of the intermediate path 81. The discharge pusher 82 has a contact face that is brought into contact with the back of the gusset bag B2. The contact face of the discharge pusher 82 can be moved forward and backward.

The discharge pusher 82 comes into contact with the back of the gusset bag B2 delivered to the end on the upstream side of the intermediate path 81. The discharge pusher 82 moves the contact face forward (downstream) at a prescribed time interval (refer to FIG. 11F). The gusset bag B2 is thereby moved from the upstream side to the downstream side of the intermediate path 81. More specifically, the gusset bag B2 is pushed from the most upstream region of the intermediate path 81, that is, from the position on a straight line from the horizontal plane 710 of the bottom-forming mechanism 7.

9-4) Belt Conveyer

As shown in FIGS. 11A through 11H, the belt conveyer 83 is disposed downstream from the intermediate path 81. The belt conveyer 83 conveys downstream the gusset bag B2 delivered from the intermediate path 81 upstream.

Flow of Operation of Bag-Making Packaging Machine

The film-feeding unit 5 feeds a sheet-form film F to the bag-making packaging unit 6. The sheet-form film F fed by the film-feeding unit 5 first passes through the hem-forming mechanism 61 (refer to FIG. 3). Hem parts H1 through H4 are formed on the sheet-form film F.

The sheet-form film F then passes through the molding mechanism 31 (refer to FIGS. 2A and 2B). The sheet-form film F by passing through the molding mechanism 31 is molded into a polygonal tubular film Fm having hem parts H1 through H4.

The polygonal tubular film Fm is transported downstream by the pull-down belt mechanism 32. The overlapping parts of the polygonal tubular film Fm transported downstream are heated and bonded by the longitudinal sealing mechanism 33. A longitudinal seal area L1 is thereby formed on the polygonal tubular film Fm.

The polygonal tubular film Fm next is sent to the gusset-forming mechanism 35 (refer to FIG. 4). The polygonal tubular film Fm is held between the folding-in members 35*a*, 35*b* and the guides 312, 312, . . . and is folded (refer to FIG. 5A). Gussets G, G are thereby formed on the polygonal tubular film Fm.

Figure 6:
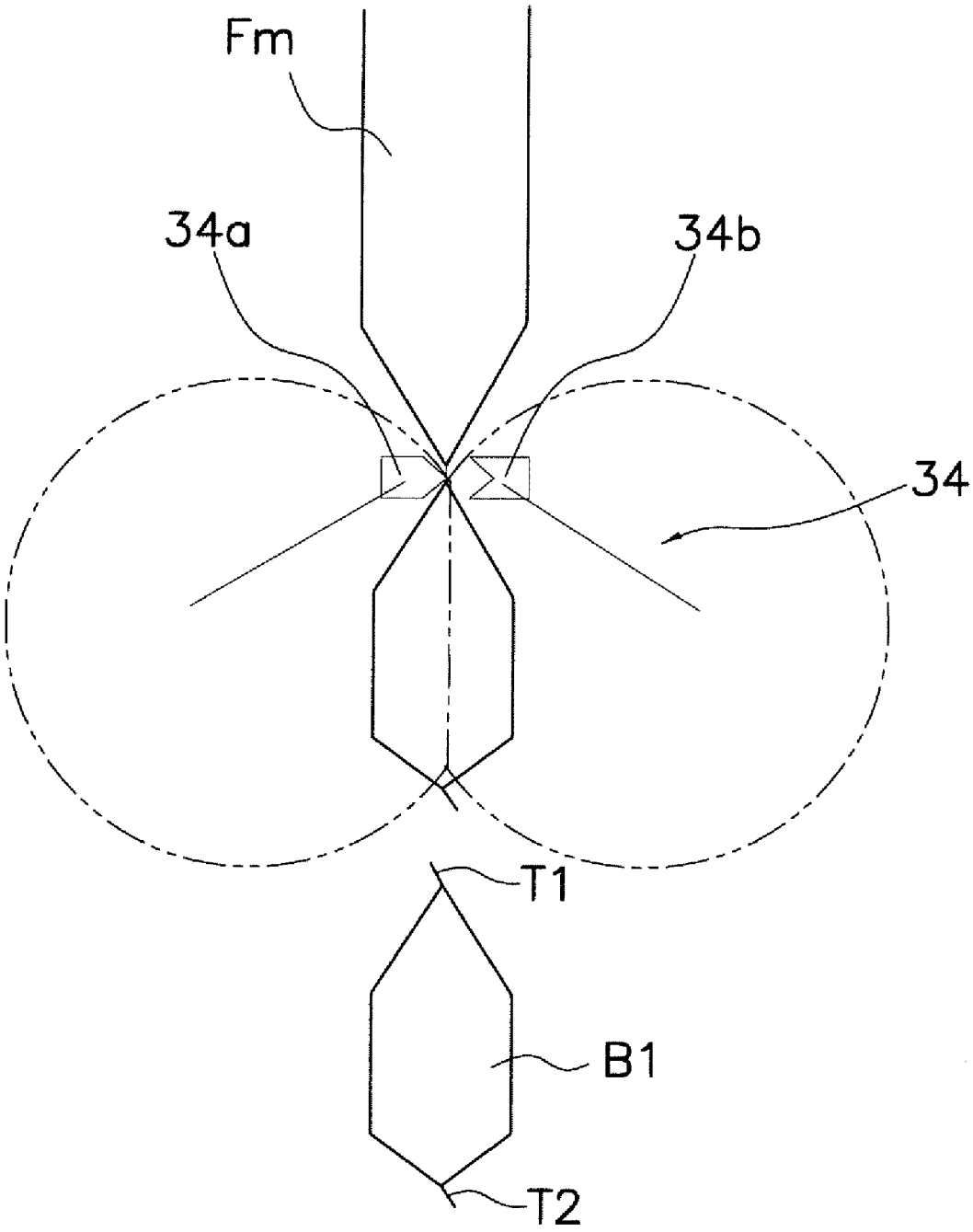
FIG. 6 is a schematic view showing the thermocompression bonding and cutting operations of the transverse sealing mechanism.

The polygonal tubular film Fm is transported further downstream and is transversely sealed by the transverse sealing mechanism 34 (refer to FIG. 6). Specifically, the transverse sealing mechanism 34 first forms a bottom transverse seal area T2 on the polygonal tubular film Fm. The article C to be packaged, which was weighed by the combination weighing device 2, is introduced from the tube 31*a* into the polygonal tubular film Fm at the timing in which the transverse sealing mechanism 34 forms or formed the bottom transverse seal area T2. The bottom transverse seal area T2 is inclined at a prescribed angle by the gap 22 formed between the pair of sealing jaws 34*a*, 34*b* (refer to FIG. 7). The bottom transverse seal area T2 inclined at a prescribed angle is further inclined by the seal orientation correcting mechanism 36, and is brought into contact with the part BB' corresponding to a bottom part of the tubular bag B1 (refer to FIG. 8).

The transverse sealing mechanism 34 further forms a top transverse seal area T1 on the polygonal tubular film Fm. The transverse sealing mechanism 34 cuts the center of the top transverse seal area T1 by a cutter (not shown). The tubular bag B1 is thereby cut off from the polygonal tubular film Fm.

The bottom part BB of the gusset bag B2 is formed by the bottom-forming mechanism 7 on the tubular bag B1 cut off and dropped from the polygonal tubular film Fm (refer to FIGS. 9 and 10).

Figure 11B:
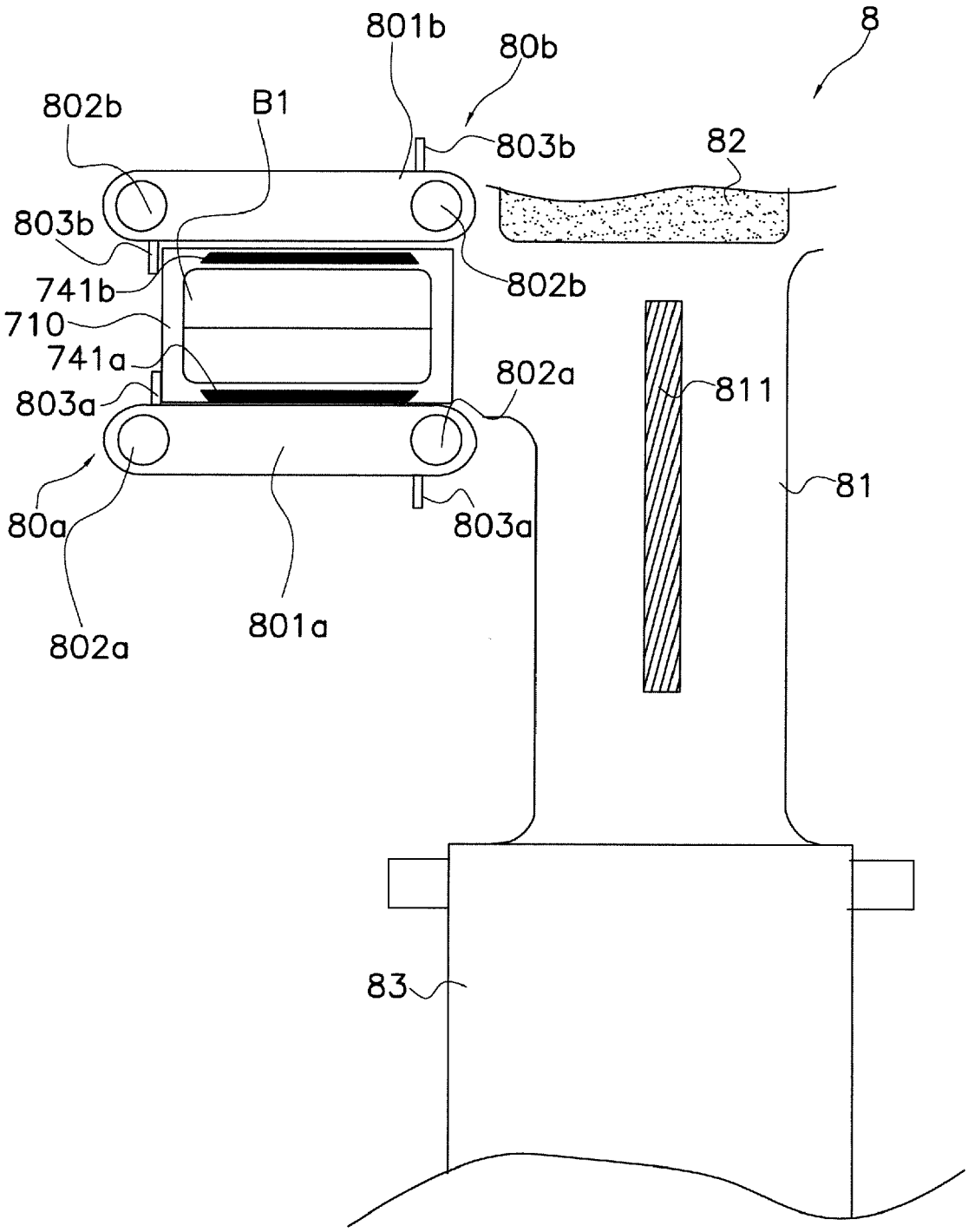
FIG. 11B is a view showing the state in which a tubular bag was dropped in FIG. 11A.
Figure 11C:
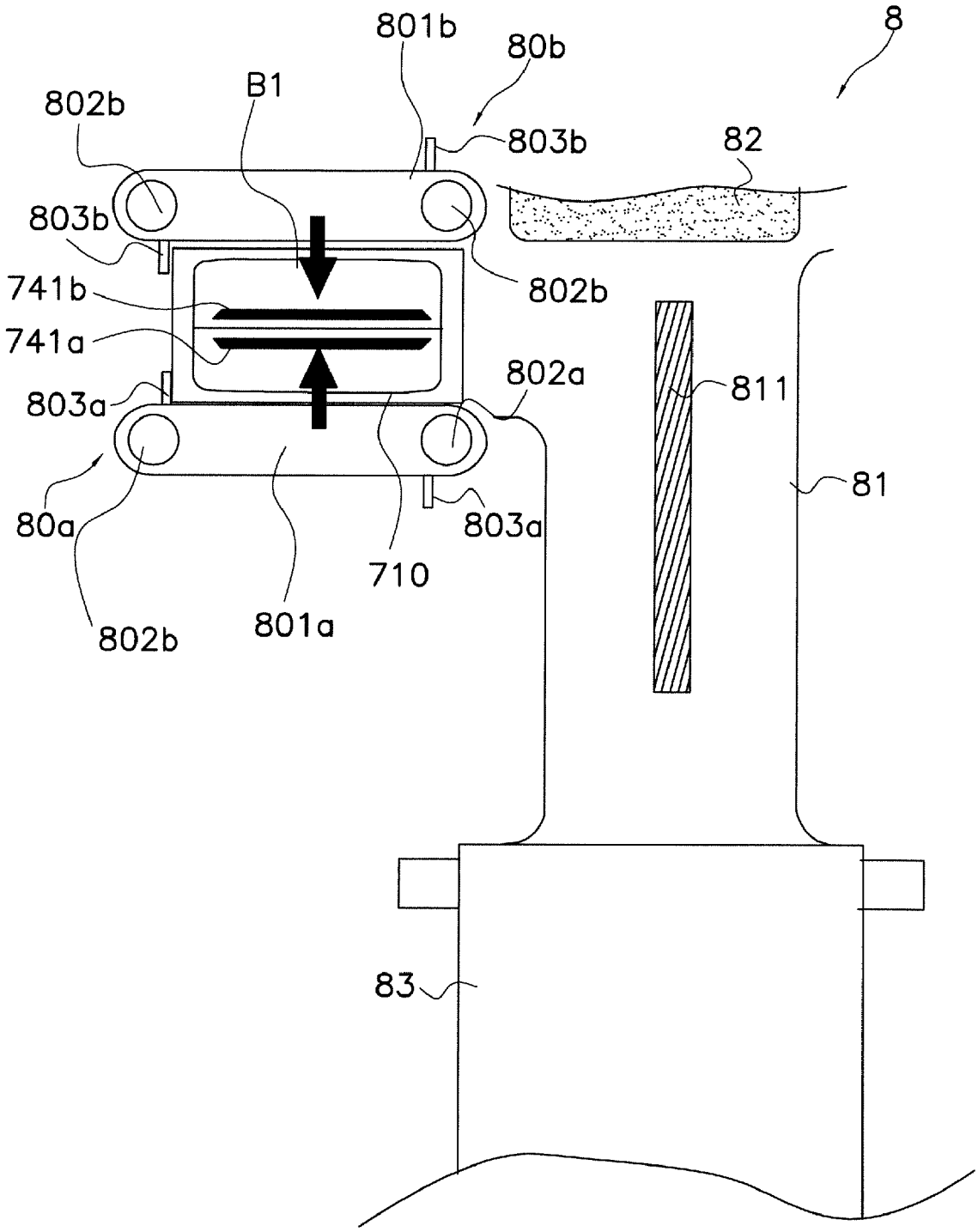
FIG. 11C is a view showing the state in which the contact members were moved by the forward/backward-moving cylinder following FIG. 11B.
Figure 11D:
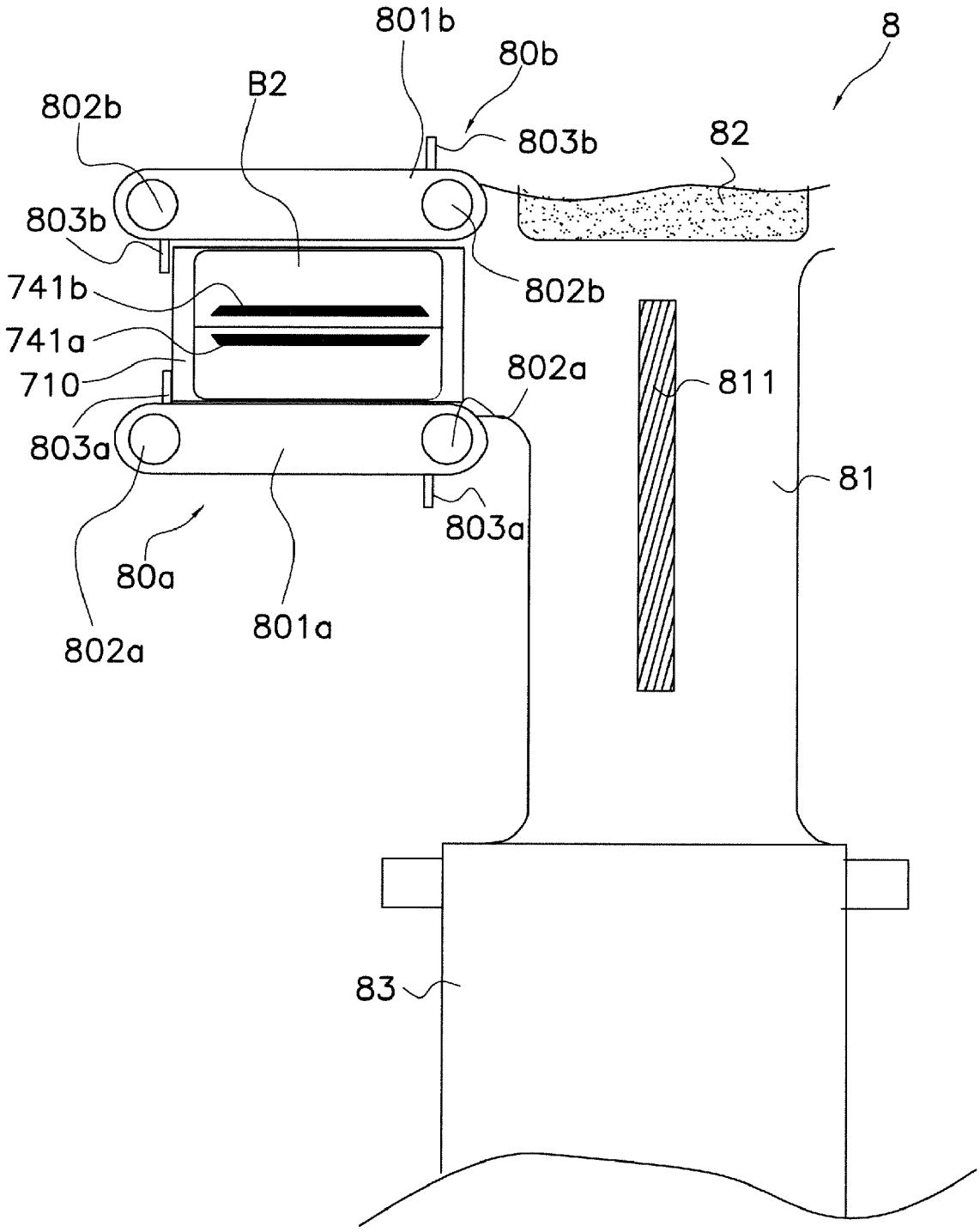
FIG. 11D is a view showing the state in which the contact members were moved by the upward/downward-moving cylinder following FIG. 11C.

Specifically, the dropped tubular bag B1 is first received and held by the bag receiving part 71 (refer to FIG. 11B). Next the pressing mechanism 74 comes into contact with the top of the tubular bag B1, and presses the tubular bag B1 against the bag receiving part 71 (refer to FIGS. 9 and 11C, and FIGS. 10 and 11D).

Specifically, the moving units 742*a*, 742*b*, 743*a*, 743*b* brings the contact members 741*a*, 741*b* inclined at a prescribed angle θ3 into contact with the top of the tubular bag B1 from the front and back faces of the tubular bag B1, and applies a force to the tubular bag B1. Therefore, the same effect can thereby be obtained as when the contact members 741*a*, 741*b* are pressed horizontally and vertically with respect to the bag B1. More specifically, the front-side contact member 741*a* disposed on the front side of the tubular bag B1, and the back-side contact member 741*b* disposed on the back side of the tubular bag B1 are moved toward the tubular bag B1 by the forward/backward-moving cylinders 742*a*, 742*b*, respectively, to correct the orientation of the tubular bag B1 (refer to FIGS. 9 and 11C). The front-side contact member 741*a* and the back-side contact member 741*b* are pushed downward by the upward/downward-moving cylinders 743*a*, 743*b*, and a downward force is applied to the tubular bag B1 (refer to FIGS. 10 and 11D).

At this time, the heater 710*b* (heating unit) installed in the horizontal plane 710 is in the ON state. Heat is therefore applied by the heater 710*b* to the overlapping portion of the bottom transverse seal area T2 and the part BB' corresponding to a bottom part, which is a portion in contact with the heater 710*b*. The bottom transverse seal area T2 and the part BB' of the main body can thereby be made to adhere firmly.

At this time, the vacuum devices 73, 73 also are in the ON state. The vacuum devices 73, 73 therefore suction the part BB' corresponding to a bottom part, and the main body in the vicinity of the part BB' corresponding to a bottom part of the tubular bag B1, which are pressed against the horizontal plane, via the plurality of holes 710*a*, 710*a*, . . . formed in the horizontal plane 710.

The main body in the vicinity of the part BB' corresponding to a bottom part of the tubular bag B1 is made to adhere closely to the bag receiving part 71 by the pressing mechanism 74 and the vacuum devices 73. The bottom part BB of the gusset bag B2 is thereby formed into a rectangular form obtained from the horizontal plane 710 and the vertical planes 711*a*, 711*b* of the bag receiving part 71. Also, a downward force (suction force) can be applied to the tubular bag B1.

Figure 11E:
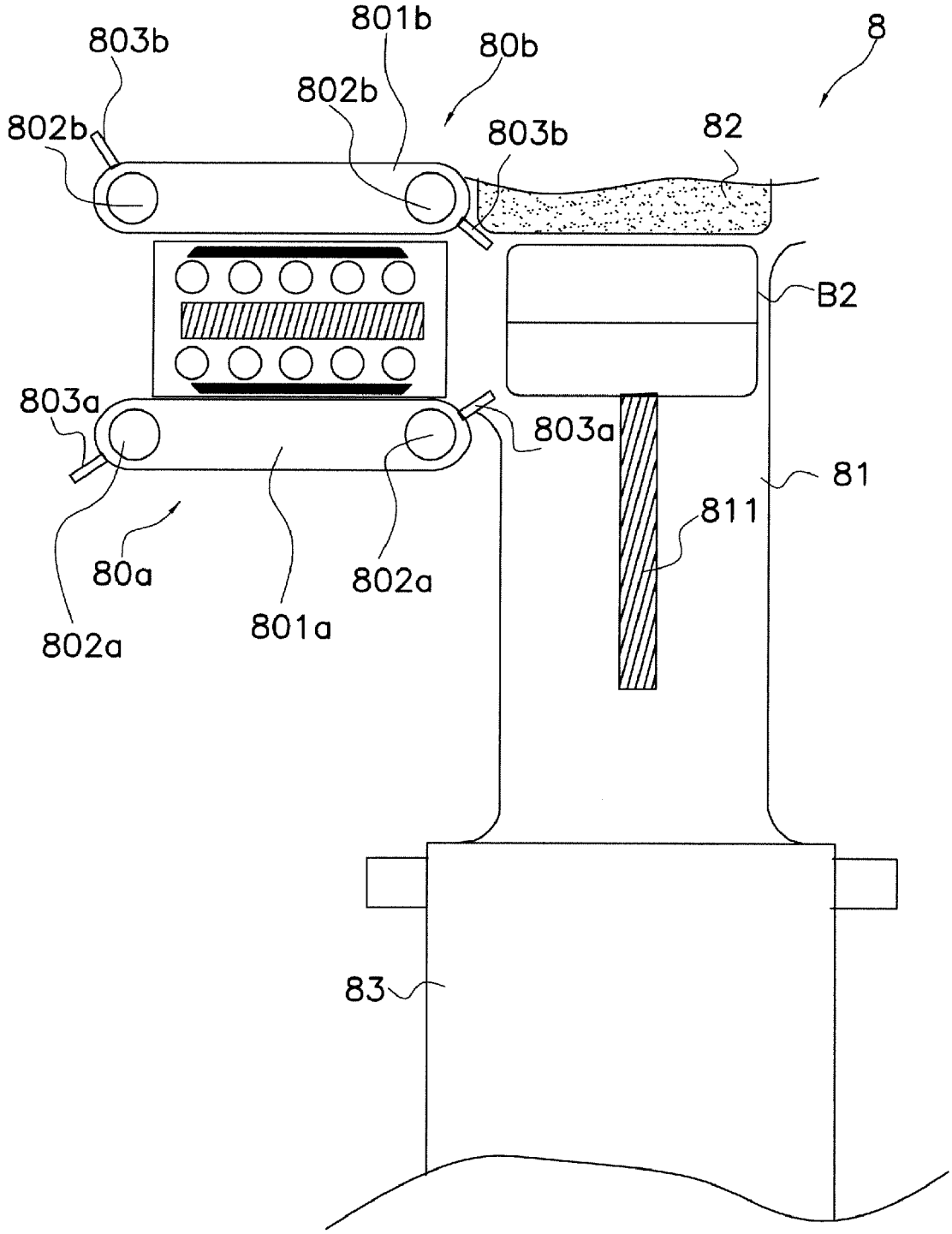
FIG. 11E is a view showing the state in which the gusset bag was delivered to a intermediate path.
Figure 11F:
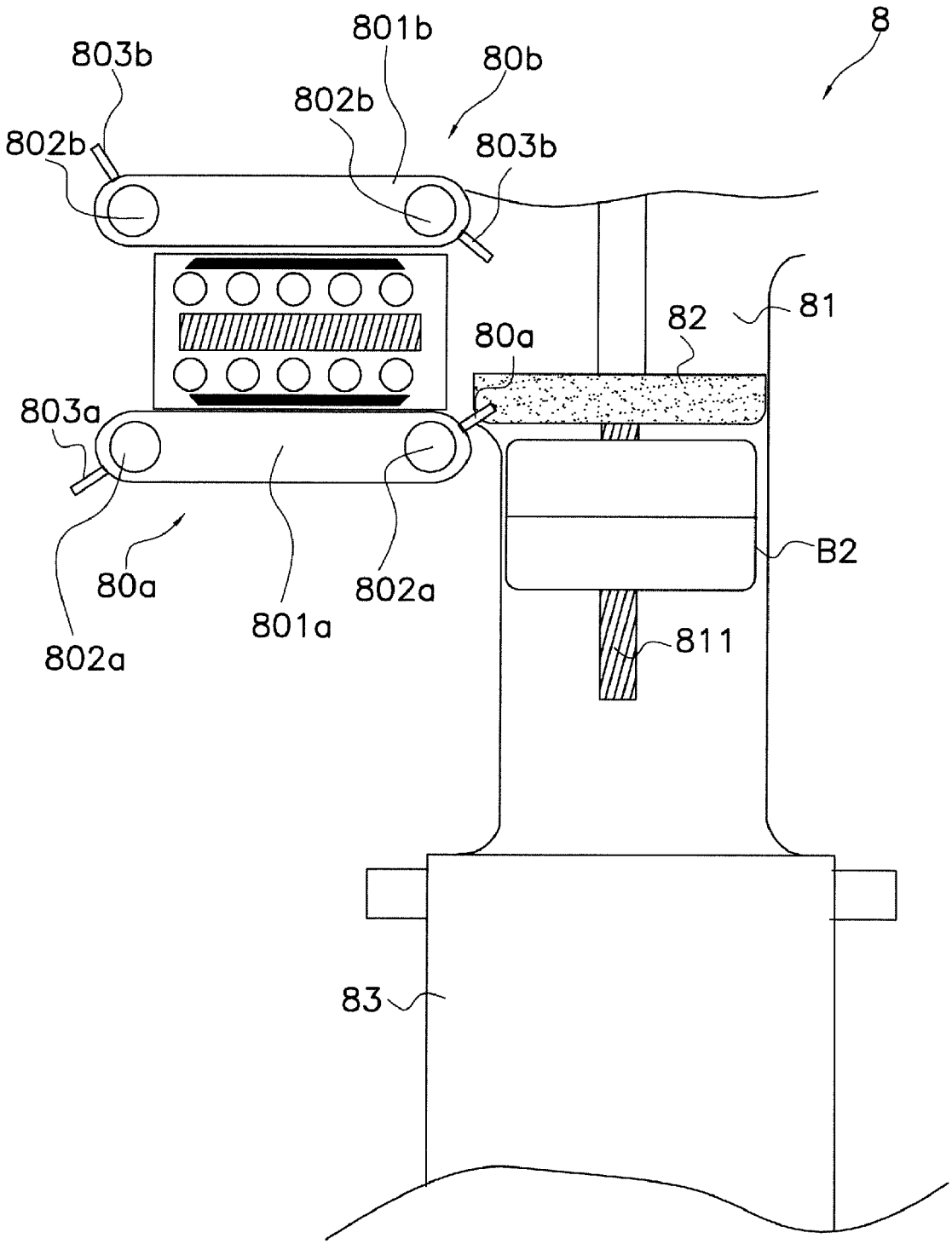
FIG. 11F is a view showing the state in which the gusset bag has been pushed downstream by a discharge pusher.
Figure 11G:
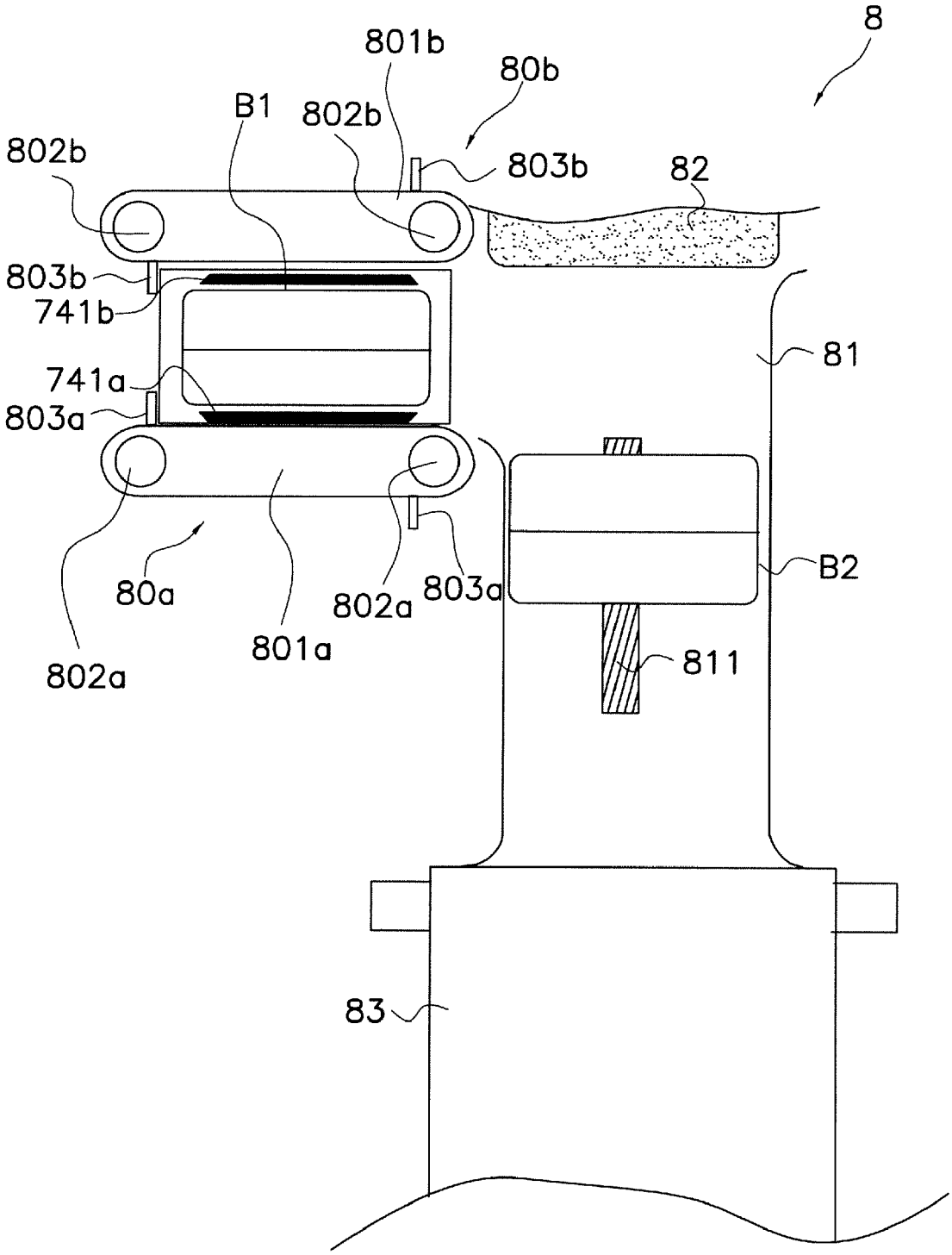
FIG. 11G is a view showing the state in which a new tubular bag was dropped to the bag receiving part following FIG. 11F.
Figure 11H:
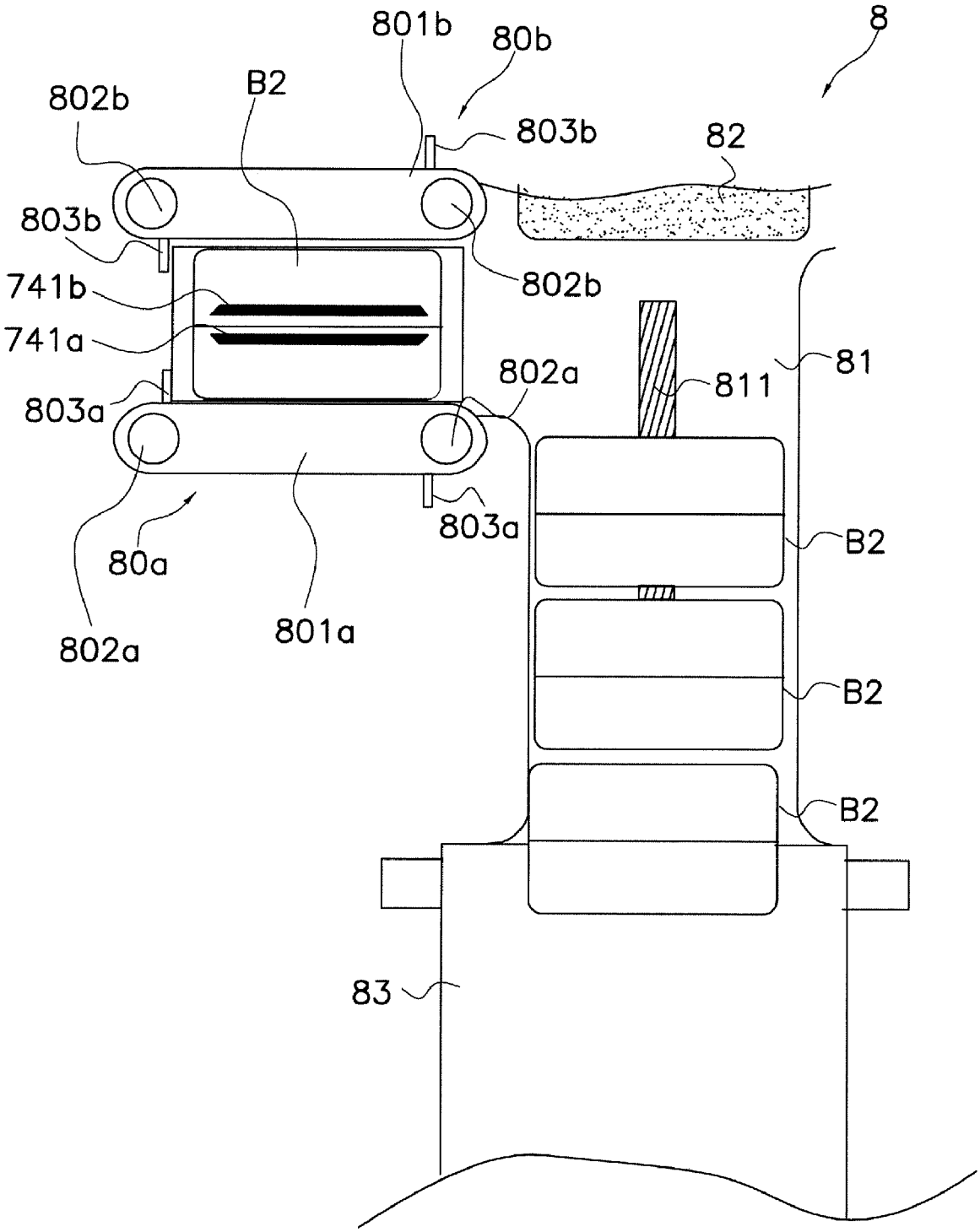
FIG. 11H is a view showing the state in which a plurality of gusset bags was delivered to the intermediate path.

The gusset bag B2 is delivered from the bottom-forming mechanism 7 to the intermediate path 81 by the delivery parts 80*a*, 80*b* (refer to FIG. 11E). The back of the gusset bag B2 delivered to the intermediate path 81 is pushed by the discharge pusher 82 at a prescribed time interval, and the gusset bag B2 moves downstream (refer to FIG. 11F). A new tubular bag B1 drops onto the bag receiving part 71 (refer to FIG. 11G). A plurality of gusset bags B2, B2, B2 continues in a line on the intermediate path 81 (refer to FIG. 11H). The leading gusset bag B2 of the plurality of gusset bags B2, B2, B2 lined up on the intermediate path 81 is delivered to the belt conveyer 83 so as to be pushed by the subsequent gusset bags B2, B2, B2.

Characteristics of Bag-Making Packaging Machine (1) In the bag-making packaging machine 10 of the embodiment, the bottom-forming mechanism 7 is provided below the transverse sealing mechanism 34. The bottom-forming mechanism 7 receives and holds the dropped tubular bag B1 at the bag receiving part 71, and forms the bottom part BB on the gusset bag B2. At this time, in the case when the article being packaged is heavy, such as coffee or flour, the bottom part BB can be formed stably by utilizing the weight of the article being packaged. That is, the overlapping portion of the bottom transverse seal area T2 and the part BB' corresponding to a bottom part can be adequately thermocompression bonded by the weight of the article being packaged, and a bottom part BB having sufficient surface area can be formed.

However, in the case when the article being packaged is lightweight, such as potato chips or marshmallows, thermocompression bonding of the overlapping portion of the bottom transverse seal area T2 and the part BB' corresponding to a bottom part becomes insufficient, and a bottom part BB having sufficient surface area cannot be formed.

In the bottom-forming mechanism 7 according to the present embodiment, the vacuum devices 73 suction the tubular bag B1 via the plurality of holes 710*a*, 710*a*, . . . formed on the horizontal plane so as to make the tubular bag B1 adhere closely to the bag receiving part 71 (refer to FIG. 10) when the tubular bag B1 is dropped. The overlapping portion of the bottom transverse seal area T2 and the part BB' corresponding to a bottom part can thereby be adequately thermocompression bonded, and a bottom part BB having sufficient surface area can be formed regardless of the weight of the article being packaged.

By this method, the operating speed of the bag-making packaging machine 10 can be maintained, and gusset-type bags can be formed quickly.

(2) The bag-making packaging machine 10 according to the above embodiment has a pressing mechanism 74. Specifically, the forward/backward-moving cylinders 742*a*, 742*b* operate when a tubular bag B1 drops onto the bag receiving part 71, and the front-side contact member 741*a* and the back-side contact member 741*b* come into contact with the tubular bag B1 from the front side and back side of the tubular bag B1. The tubular bag B1 can thereby be brought to a proper angle even in the case, for example, when the tubular bag B1 is inclined when dropped onto the bag receiving part 71.

The upward/downward-moving cylinders 743*a*, 743*b* are caused to operate, and the front-side contact member 741*a* and the back-side contact member 741*b* apply a downward force to the tubular bag B1. The main body in the vicinity of the part BB' corresponding to a bottom part, at first not being in contact with the bag receiving part 71, is thereby pushed wider so as to adhere closely to the horizontal plane 710 and the vertical planes 711*a*, 711*b* of the bag receiving part 71. A gusset bag B2 having an adequate rectangular bottom shape that conforms to each plane of the bag receiving part 71 can thereby be formed stably. The gusset bag B2 can be made into a more stable form by pushing down the article C to be packaged together with the air inside the gusset bag B2.

(3) In the bag-making packaging machine 10 according to the above embodiment, the front-side contact member 741*a* and the back-side contact member 741*b* are inclined at a prescribed angle with respect to the tubular bag B1. A downward force is therefore applied to the tubular bag B1 even in the case when the front-side contact member 741*a* and the back-side contact member 741*b* are moved and brought into contact with the tubular bag B1 by the forward/backward-moving cylinders 742*a*, 742*b*. The gusset bag B2 can thereby be formed while the tubular bag B1 is stabilized.

(4) In the bag-making packaging machine 10 according to the above embodiment, a heater 710*b* is installed in the horizontal plane 710 of the bag receiving part 71. The bottom transverse seal area T2 can therefore be made to adhere closely to the part BB' corresponding to a bottom area.

(5) In the bag-making packaging machine 10 according to the above embodiment, the gap 22 formed between the opposite faces of the pair of sealing jaws 34*a*, 34*b* is roughly V-shaped. A bottom transverse seal area T2 inclined in a fixed direction is thereby formed. The bottom transverse seal area T2 is inclined further by the seal orientation correcting mechanism 36 for correcting the orientation of a bottom transverse seal area before the tubular bag B1 is cut off from the polygonal tubular film Fm. The bottom transverse seal area T2 can thereby be brought into contact with the part BB' corresponding to a bottom part when the tubular bag B1 drops onto the bag receiving part 71.

MODIFIED EXAMPLES (A) In the above embodiment, an example of continuous form/fill/seal operation was described, but the form/fill/seal operation may be intermittent. Even in this case, form/fill/seal operation that is quicker than conventionally becomes possible.

Figure 12A:
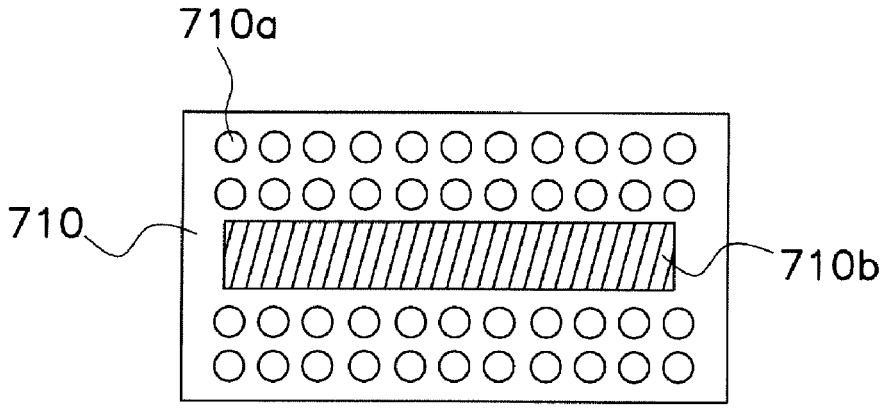
FIG. 12A is a front view of a horizontal plane according to a modified example (B).
Figure 12B:
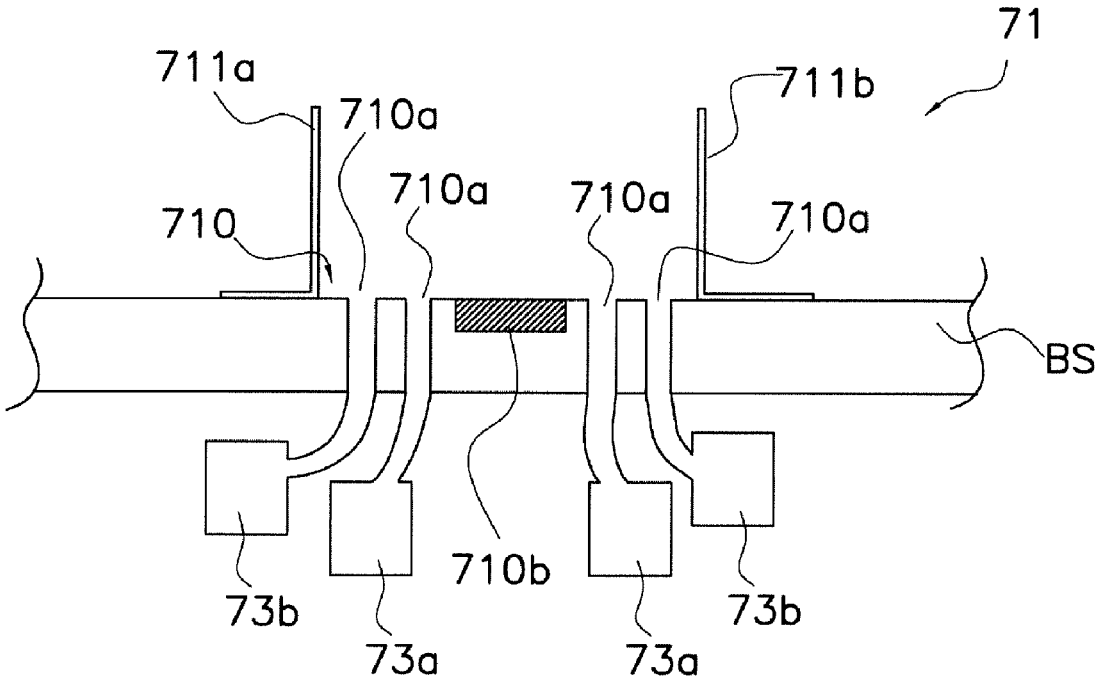
FIG. 12B is a view showing a bag receiving part and a vacuum according to a modified example (B).

(B) In the above embodiment, two rows of holes 710*a*, 710*a*, . . . arranged in the long direction are disposed one row each substantially horizontally on both sides of the heater 710*b* on the horizontal plane 710 of the bag receiving part 71, but the holes may be arranged two rows each on both sides of the heater 710*b*, as shown in FIGS. 12A and 12B. The number of rows of the plurality of holes 710*a*, 710*a*, . . . also may be designed so as to be arranged in three rows each.

At this time, the number of vacuum devices 73 may be provided in a plurality corresponding to the number of rows of holes of holes 710*a*, 710*a*, . . . as shown in FIG. 12B. In the case when a plurality of vacuum devices 73*a*, 73*b*, . . . is provided, the main body of the tubular bag B1 may be drawn or sucked first by the vacuums in the vicinity of the center. That is, the vacuum devices 73*a*, 73*a* first suction the main body of the tubular bag B1 via the holes in the vicinity of the heater 710*b*, and the main body of the tubular bag B1 is then drawn with the vacuum devices 73*b*, 73*b*. The surface area of the main body of the tubular bag B1 made to adhere closely to the horizontal plane 710 can thereby be widened gradually. That is, the shape of the bottom part BB of the gusset bag B2 can be securely brought close to the desired shape.

(C) In the above embodiment, the width of the member 361 for pushing up a bottom transverse seal area is about equal to the width of the front and back of the tubular bag B1, but the width of the member 361 for pushing up a bottom transverse seal area may be a width that ensures partial contact with the bottom transverse seal area.

The length of the member 361 for pushing up a bottom transverse seal area is about equal to the width of the right side and left side of the tubular bag B1, but the member may have a length sufficient to provide contact with the bottom transverse seal area T2.

Figure 13:
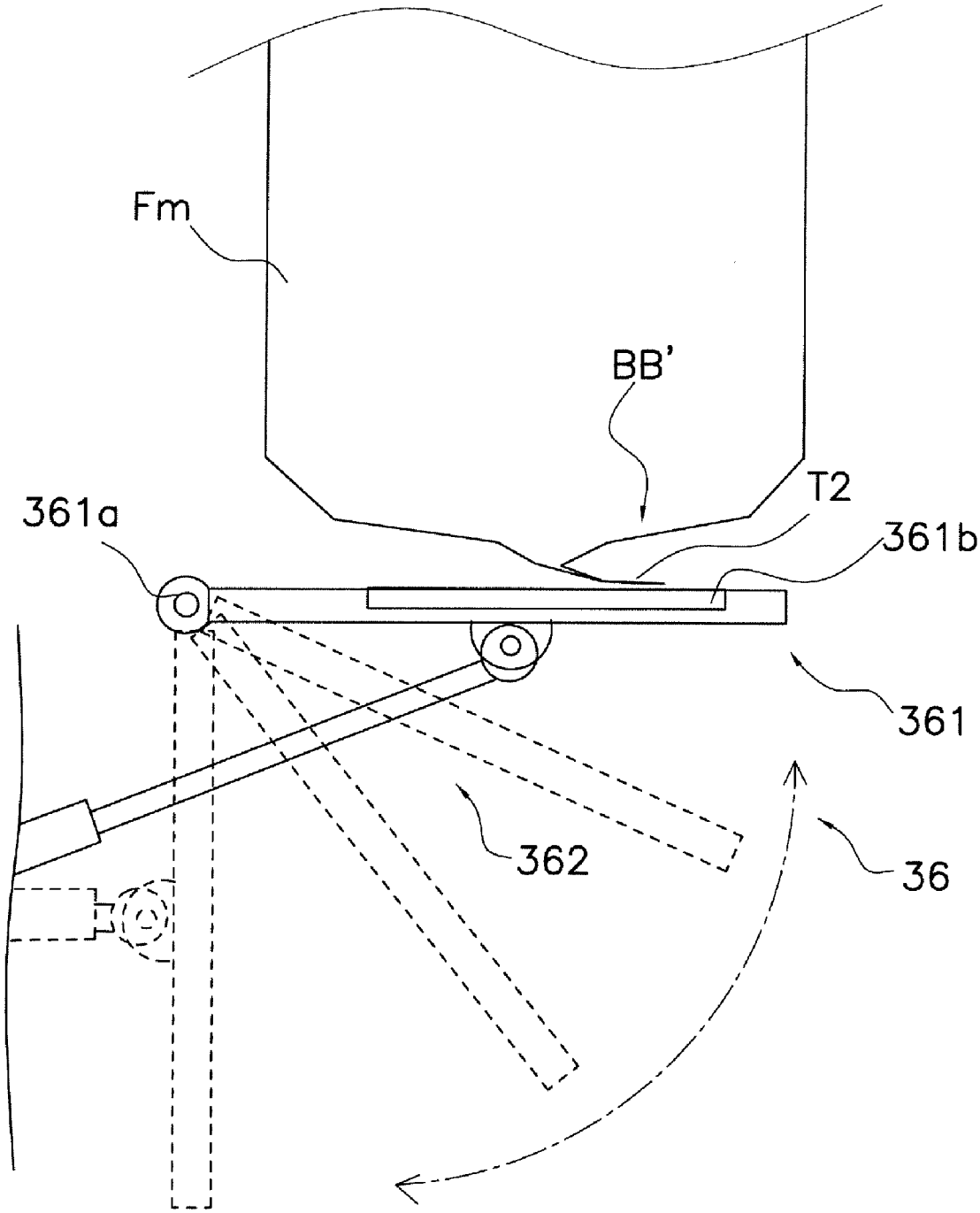
FIG. 13 is a view showing a seal orientation correcting mechanism for correcting the orientation of a bottom transverse seal area according to a modified example (C).

As shown in FIG. 13, a heater may be installed in the member 361 for pushing up a bottom transverse seal area. The bottom transverse seal area T2 and the main body can thereby adhere more firmly.

(D) In the above embodiment, the contact members 741*a*, 741*b* are moved using the forward/backward-moving cylinders 742*a*, 742*b* and the upward/downward-moving cylinders 743*a*, 743*b* when the tubular bag B1 is pressed with the pressing mechanism 74, but the tubular bag B1 may be pressed to the bag receiving part 71 using cylinders that move the contact members 741*a*, 741*b* diagonally instead of the forward/backward-moving cylinders 742*a*, 742*b* and the upward/downward-moving cylinders 743*a*, 743*b*.

The bag-making packaging machine of the present invention can be used widely as a bag-making packaging machine capable of forming a gusset-type bag without a marked reduction of manufacturing speed.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A bag-making packaging machine comprising:

a bag-producing part configured and arranged to transversely seal a tubular packaging material to produce a bag having a top seal part and a bottom seal part formed above and below a product-enclosing main body of the bag;

a bag receiving part configured and arranged to receive and hold the bottom seal part and a part of the main body of the bag, which has been dropped from the bag-producing part;

a bottom-forming part configured and arranged to deform the bag in contact with the bag receiving part to form a bottom portion of the bag into a prescribed shape; and a seal orientation correcting mechanism configured and arranged to correct an orientation of the bottom seal part of the bag with respect to the main body of the bag so that the bottom seal part is oriented generally parallel to a bottom surface of the main body before the bag is dropped onto the bag receiving part.

2. The bag-making packaging machine according to claim 1, wherein the bottom-forming part has a vacuum mechanism configured and arranged to suction the bag so that a part of the bag in contact with the bag receiving part adheres closely to the bag receiving part.

3. The bag-making packaging machine according to claim 2, wherein the bag receiving part has a receiving member defining a plurality of holes, and the vacuum mechanism is configured and arranged to suction the bag via the holes in the receiving member.

4. The bag-making packaging machine according to claim 1, wherein the bottom-forming part has a pressing mechanism configured and arranged to press the bag against the bag receiving part.

5. The bag-making packaging machine according to claim 4, wherein the bag-producing part is configured and arranged to produce the bag so that a front surface and a back surface of the bag are made wider than two side surfaces of the bag, and the pressing mechanism has a first member configured and arranged to contact with a top portion of the main body of the bag on the front surface, a second member configured and arranged to contact with the top portion of the main body of the bag on the back surface, and a first moving unit configured and arranged to press the first member and the second member against the bag.

6. The bag-making packaging machine according to claim 5, wherein the first and second members have contacting surfaces configured and arranged to contact the front surface and the back surface of the bag, respectively, with the contacting surfaces being oriented diagonally downward.

7. The bag-making packaging machine according to claim 5, wherein the pressing mechanism further has a second moving unit configured and arranged to move the first member and the second member downwardly while the first member and the second member are pressed against the bag by the first moving unit.

8. The bag-making packaging machine according to claim 1, wherein the bag-producing part is configured and arranged to produce the bag so that a front surface and a back surface of the bag are made wider than two side surfaces of the bag, the bag receiving part forms a horizontal plane on which the bottom seal part and a part of the main body of the bag are carried, a front-side vertical plane that rises perpendicularly from the horizontal plane and is arranged to face the front surface of the bag, and a back-side vertical plane that rises perpendicularly from the horizontal plane and is arranged to face the back surface of the bag, and the bottom-forming part is configured and arranged to deform the bag so that the packaging material of the bag in contact with the bag receiving part conforms to the horizontal plane, the front-side vertical plane, and the back-side vertical plane.

9. The bag-making packaging machine according to claim 1, wherein the bottom-forming part is configured and arranged to deform the bag so as to conform to a shape of the bag receiving part.

10. The bag-making packaging machine according to claim 1, further comprising a heating unit configured and arranged to heat the bag in contact with the bag receiving part.

11. The bag-making packaging machine according to claim 1, wherein the seal orientation correcting mechanism is further configured and arranged to heat the bottom seal part while correcting the orientation of the bottom seal part.

* * * * *